US008667959B2

(12) United States Patent
Tilley et al.

(10) Patent No.: US 8,667,959 B2
(45) Date of Patent: Mar. 11, 2014

(54) MODULAR POWERED AIR PURIFYING RESPIRATOR

(75) Inventors: Greg A. Tilley, Monkton, MD (US); James Wilcox, Baltimore, MD (US); John Patrick Fick, Baltimore, MD (US)

(73) Assignee: Avon Protection Systems, Inc., Cadillac, MI (US)

( * ) Notice: Subject to any disclaimer, the term of this patent is extended or adjusted under 35 U.S.C. 154(b) by 445 days.

(21) Appl. No.: 12/783,870

(22) Filed: May 20, 2010

(65) Prior Publication Data

US 2010/0224190 A1 Sep. 9, 2010

Related U.S. Application Data

(63) Continuation-in-part of application No. PCT/US2008/084158, filed on Nov. 20, 2008.

(60) Provisional application No. 60/989,223, filed on Nov. 20, 2007.

(51) Int. Cl.

| | |
|---|---|
| ***A62B 7/10*** | (2006.01) |
| ***A62B 17/00*** | (2006.01) |
| ***A62B 19/00*** | (2006.01) |
| ***A62B 23/02*** | (2006.01) |

(52) U.S. Cl.
USPC ..... 128/201.25; 128/201.29; 128/205.12

(58) Field of Classification Search
USPC ..... 128/201.22–29, 202.27, 204.18, 128/204.19, 204.21, 205.12, 205.25, 128/205.27–29, 206.12, 206.17
See application file for complete search history.

(56) References Cited

U.S. PATENT DOCUMENTS

| | | | | |
|---|---|---|---|---|
| 4,646,732 | A | 3/1987 | Chien | |
| 4,671,300 | A * | 6/1987 | Grube et al. | 55/385.8 |
| 4,886,056 | A | 12/1989 | Simpson | |
| 5,022,900 | A | 6/1991 | Bar-Yona et al. | |
| 5,113,853 | A | 5/1992 | Dickey | |
| 5,318,020 | A | 6/1994 | Schegerin | |
| 5,372,130 | A | 12/1994 | Stern et al. | |
| 5,394,870 | A | 3/1995 | Johansson | |
| 5,906,203 | A * | 5/1999 | Klockseth et al. | 128/205.24 |
| 6,435,184 | B1 | 8/2002 | Ho | |
| 6,575,165 | B1 * | 6/2003 | Cook et al. | 128/206.17 |
| 7,013,891 | B2 | 3/2006 | Richardson et al. | |
| 7,213,595 | B2 * | 5/2007 | Capon et al. | 128/205.27 |
| 7,748,381 | B2 * | 7/2010 | Croll et al. | 128/204.18 |
| 2006/0048782 | A1 | 3/2006 | Gossweiler | |
| 2006/0231100 | A1 * | 10/2006 | Walker et al. | 128/205.25 |
| 2007/0131228 | A1 | 6/2007 | Croll et al. | |
| 2007/0163588 | A1 | 7/2007 | Hebrank et al. | |

FOREIGN PATENT DOCUMENTS

| | | | |
|---|---|---|---|
| EP | 0164946 | A2 | 12/1985 |
| GB | 2247175 | A | 2/1992 |
| WO | 2007070308 | A1 | 6/2007 |

* cited by examiner

*Primary Examiner* — (Jackie) Tan-Uyen T. Ho
*Assistant Examiner* — Mark K Han
(74) *Attorney, Agent, or Firm* — McGarry Bair PC

(57) ABSTRACT

A modular powered air purifying respirator (PAPR) which is comprised of a fan, motor, scroll, and power source mounted within one housing, and which accepts either traditional or conformal filters. Ambient air is drawn into the PAPR module through the attached filter by a fan, which is driven by direct connection to a motor. The pressurized air is then accelerated by an optimized scroll to the outlet in the PAPR housing. The PAPR module can be employed in multiple use configurations. The PAPR module further comprises a removable battery pack module that is easily retained to/removed from the PAPR module, enabling a user to be able to quickly remove a spent battery pack module and install a fresh battery pack module, thereby replacing the batteries within one breath cycle.

35 Claims, 25 Drawing Sheets

MODULAR POWERED AIR PURIFYING RESPIRATOR

CROSS-REFERENCE TO RELATED APPLICATION

This application is a continuation-in-part of International Patent Application No. PCT/US2008/084158 filed Nov. 20, 2008, which claims the benefit of U.S. Provisional Patent Application No. 60/989,223, filed on Nov. 20, 2007, both of which are incorporated herein by reference in their entirety.

BACKGROUND OF THE INVENTION

1. Field of the Invention

The invention relates to powered air purifying respirators. In one of its aspects, the invention relates to a modular powered air purifying respirator that is adapted to be removably mounted to a respirator mask and to a filter canister. In another of its aspects, the invention relates to a modular powered air purifying respirator that is adapted to be removably mounted to a hose that is connected to a respirator mask. In yet another of its aspects, the invention relates to a modular powered air purifying respirator that has a portable, rechargeable power source. In yet another of its aspects, the invention relates to a sealed modular powered air purifying respirator that has a replaceable, portable power source. In yet another of its aspects, the invention relates to a modular powered air purifying respirator which delivers a constant flow of purified air to a respirator in the event of partial filter clogging. In another of its aspects, the invention relates to a modular powered air purifying respirator with a removable battery pack.

2. Description of the Related Art

Powered air-purifying respirators (PAPRs) continually supply positive air pressure to a respirator to maintain positive pressure in the respirator. PAPRs are generally used in military, industrial or hazardous environments to provide personal respiratory protection by preventing ambient air from entering the user's mask, helmet, or hood. Respiratory hazards might include particulate matter, harmful gases, or vapors, which are removed by passing the ambient air through the filter. Typically, a powered air-purifying respirator includes a powered fan that forces ambient air through one or more filters for delivery to an inlet opening in the respirator. The fan and filter may be mounted on a facemask, or in some cases, may be mounted on a belt or backpack and connected to the facemask through a hose and a fan. Power for the fans are typically mounted remote from the facemask but can also be mounted on the mask itself.

U.S. Pat. No. 4,886,056 to Simpson discloses a positive pressure filter respirator that is mounted on a full face mask comprising an outer mask and an inner orinasal mask. The outer mask includes an air inlet to which a filter canister is screw-mounted. Immediately within the filter canister is located a centrifugal fan which is arranged to be driven by a battery operated motor so as to draw ambient air through the filter canister and into the interior of the outer mask.

U.S. Pat. No. 6,435,184 to Ho discloses a PAPR gas mask having a second filter body disposed in front of the filter body. The gas mask structure includes a rear cup body, two battery seats and a front cup body. The battery seats are respectively disposed on two sides of the bottom of the rear cup body for receiving batteries therein to provide power for a motor to drive a fan. A filter body is positioned in a fixing seat of the front cup body. A cover body is screwed on the fixing seat to fix the filter body therein and tightly hold a second filter body in front of the filter body. The fan serves to generate air flow which is filtered through the second filter body and the filter body and then conducted into the guide way of the rear cup body. The batteries are rechargeable by plugging in a charger.

U.S. Patent Application Publication No 2007/0163588 to Hebrank et al discloses a personal respirator and clean air system comprising an air mover, a particle filter, and a supply means mounted to a belt. The respirator is operably connected to a face mask by a supply hose, the opposite end of the supply hose being attached to the PAPR housing. The system typically includes a power supply, which can take the form of at least one battery or multiple batteries mounted in a cartridge, or a re-chargeable battery pack receivable in a compartment in the housing. For certain end uses, the system can instead, or in addition, include an AC adapter to allow the system to be powered off an AC outlet or to facilitate charging of the batteries. The AC adaptor can be mounted inside the housing.

SUMMARY OF THE INVENTION

According to the invention, a modular powered air purifying respirator (PAPR) comprises a housing, a fan, a motor, and at least one battery mounted within a housing. The housing has a central axis and is formed by an upper cylindrical portion and a lower cylindrical portion, and the upper cylindrical portion and the lower cylindrical portions are axially aligned. The fan is mounted within the lower cylindrical portion and has a fan inlet and a fan outlet. The motor is connected to the fan for driving the fan. The at least one battery is mounted in the upper cylindrical portion and is connected to the motor for powering the motor. An inlet opening is formed in the upper cylindrical portion of the housing for selectively mounting a filter canister for filtering air that is drawn into the inlet opening. An outlet opening is formed in the lower cylindrical portion of the housing in communication with the fan outlet and the inlet and outlet openings are co-axially aligned; A releasable mounting connector is configured to mount the housing to a facepiece of a respirator mask or to a conduit that is fluidly connected a facepiece inlet opening of a respirator mask. The modular PAPR can thus be positioned between a filter canister and a respirator mask, or between a filter and a conduit connected to a respirator mask, to draw air in axial flow through the filter and deliver filtered air to a mask.

In one embodiment, the at least one battery is rechargeable. Typically, there are multiple batteries that are spaced annularly about a central axis of the housing.

In another embodiment, the housing further has a receptacle electrically connected to the motor for powering the motor. In addition, the receptacle electrically can be connected to the power source for recharging the power source. Further, the (PAPR) module can have a control circuit electrically connected to the motor and the power source for controlling the power to the motor.

In a preferred embodiment, a scroll is mounted between the fan and the outlet opening to optimize the air flow to the respirator.

In another embodiment, the inlet opening is formed by an internally threaded sleeve. In addition, the outlet opening can be formed by an externally threaded sleeve.

In yet another embodiment, the inlet opening is formed by a bayonet connector. In addition, the outlet opening can be formed by a bayonet connector.

In use, ambient air is drawn into the inlet opening through the attached filter by the centrifugal fan, which is driven by direct connection to the shaft of the motor. The air is then accelerated by an optimized scroll to pass pressurized air through the outlet opening to a respirator mask.

The PAPR module can be employed in multiple use configurations. For example, it could also be configured for use with an air hose and belt, and worn on the waist, back, or any remote location.

Further according to the invention, the PAPR includes a removable battery pack module. The main housing has a battery pack opening and the power source is mounted within a battery pack module that is received and selectively retained within the housing battery pack opening for quick release and replacement.

In one embodiment of the invention, the battery pack module has external terminals and the battery pack opening has exposed electrical terminals that are in electrical contact with the external terminals on the battery pack module when the battery pack module is installed in the battery pack opening. Further, one of the battery pack module and the main housing has opposing resilient retainers that interface with opposed catches on the other of the main housing and the battery pack module to releasably retain the battery pack module in the battery pack opening. The battery pack module has a U-shaped housing, and the opposing resilient retainers or the opposed catches are positioned on the ends of the legs of the U-shaped housing. Additionally, the battery pack module external terminals are formed on the inside of the legs of the U-shaped housing.

The invention provides for a quick and easily replaceable battery pack that supplies power to the powered air purifying respirator. This removable battery pack can be hot swapped in a contaminated environment. Further, the PAPR module can be operated with internal batteries housed in the battery pack, power supplied by an AC outlet, or an external battery pack. Additionally, an extended life battery pack containing at least three batteries is also provided.

DESCRIPTION OF EMBODIMENTS OF THE INVENTION

Figure 1:
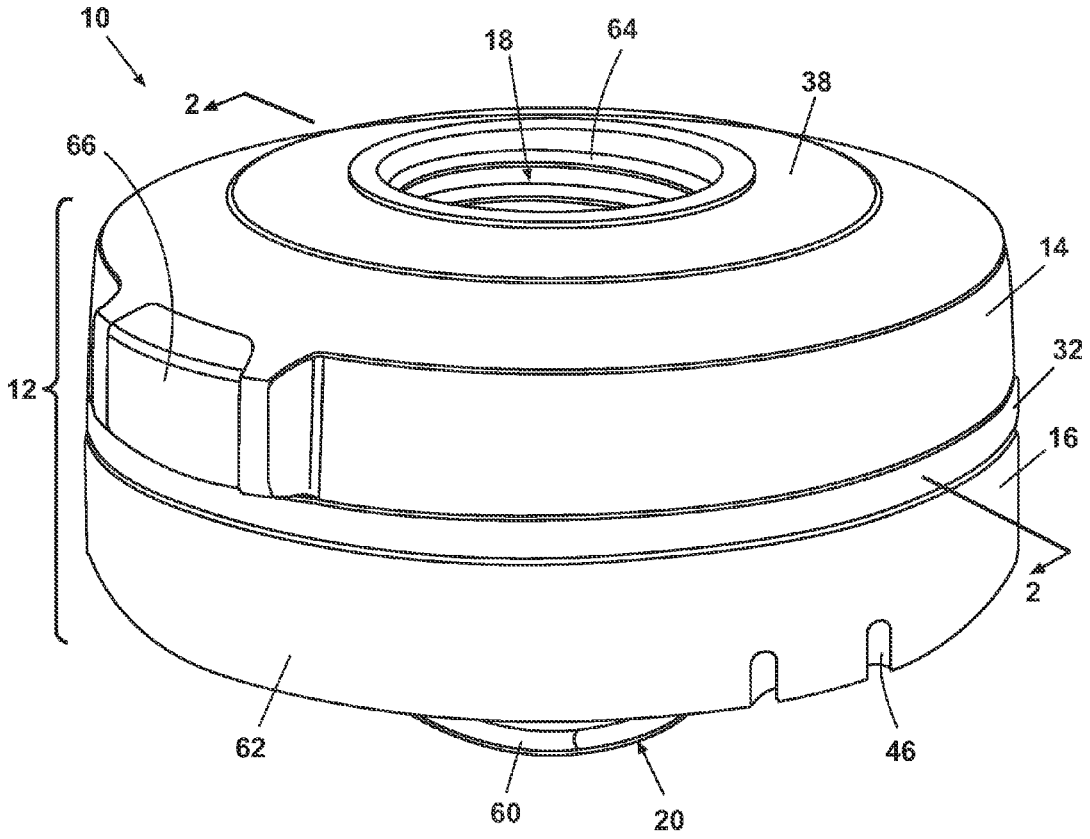
FIG. 1 is a perspective view of a PAPR module according to a first embodiment of the invention.
Figure 2:
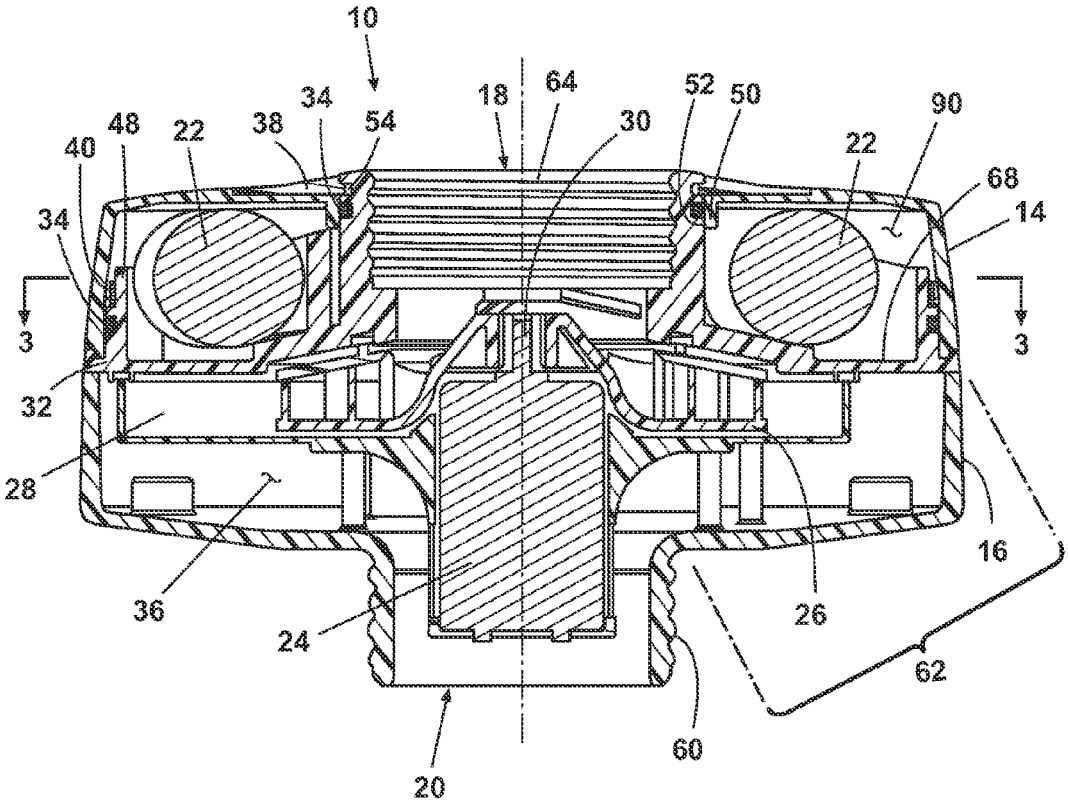
FIG. 2 is a cross-sectional view of the PAPR module taken along line 2-2 of FIG. 1.

Referring to FIGS. 1 and 2, a first embodiment of a powered air purifying respirator (PAPR) module 10 according to the present invention is illustrated. The PAPR module 10 is a self-contained, compact unit, and generally comprises a motor 24, a fan 26, a scroll 28, and a power source 22 all within a single housing 12. The PAPR module 10 has an inlet 18 that can be attached to an air filtering means, and an outlet 20 that can be attached to a user-wearable respiration protection device. The PAPR module 10 can be considered an "in-line" PAPR, wherein the inlet 18 and outlet 20 are co-axially aligned, such that the direction of inlet and outlet airflow is generally parallel to the center axis of the PAPR.

The PAPR module 10 housing 12 is comprised of two cylindrical portions, an upper body 14 and a lower body 16. The lower body 16 is circular in cross-sectional configuration, although other cross-sectional configurations are possible, and comprises two contiguous segments, a main lower body 62 and an externally threaded mask sleeve 60. The outlet 20 is defined by the threaded mask sleeve 60, which is advantageously used to couple the PAPR module 10 to a user-wearable respiration protection device, as described below.

Positioned over the open end of the lower body 16 is a lower body cover 32. The lower body cover 32 is sealed in air-tight fashion to the lower body 16 by welding, or any other suitable means. Together, the lower body 16 and lower body cover 32 form an enclosed space to create a sealed breathing zone 36 that is in fluid communication with the inlet 18 and the outlet 20. Thus, only air which has passed through an air filter canister attached to the inlet 18 can pass to a respirator through the outlet 20.

An internally threaded filter sleeve 64 extends upwardly from a face 68 of the lower body cover 32 opposite the sealed breathing zone 36. The threaded filter sleeve 64 defines the inlet 18 of the PAPR module 10 and can be used to couple an air filtering canister to the PAPR module 10.

The upper body 14 is fixed to the lower body 16 at the lower body cover 32. The upper body 14 typically has the same cross-sectional configuration as the lower body 16 to create the aesthetic appearance of a compact, self-contained unit. A circular opening 52 formed by a depending flange 50 in the top surface of the upper body 14 receives the threaded filter sleeve 64. An O ring seal 34 between the depending flange 50 and the sleeve 64 hermetically seals the sleeve 64 to the depending flange. The upper body 14 also includes an integral power switch 66, which is located on the exterior of the upper body 14. The upper body 14 can be either removably or fixedly attached to the lower body cover 32.

An O ring seal 34 is positioned on a rib 48 on the face 68 of the lower body cover 32 between at the interface between the upper body 14 and the lower body cover 32 to seal the two parts together. The O ring seals 34 are circular and can be made of any suitable elastomeric material.

A split ring, lid retaining clip 38 is positioned in a groove in the upper body 14 and is snap fit into a groove 54 on the exterior of the threaded filter sleeve 64 to retain the upper body 14 on the sleeve 64.

The centrifugal fan 26, scroll 28 and motor 24 are positioned within the sealed breathing zone 36. The centrifugal fan 26 and motor 24 are co-axial and the centrifugal fan 26 is driven by direct connection to a shaft 30 of the motor 24. The scroll 28 encircles the centrifugal fan 26 and is located between the fan and the lower body 16. The centrifugal fan 26 draws air through the inlet 18 and propels it radially. The scroll 28 then spirally directs the pressurized air toward the outlet 20. The motor 24 is preferably oriented in axial alignment with the central axis of the housing.

Figure 3:
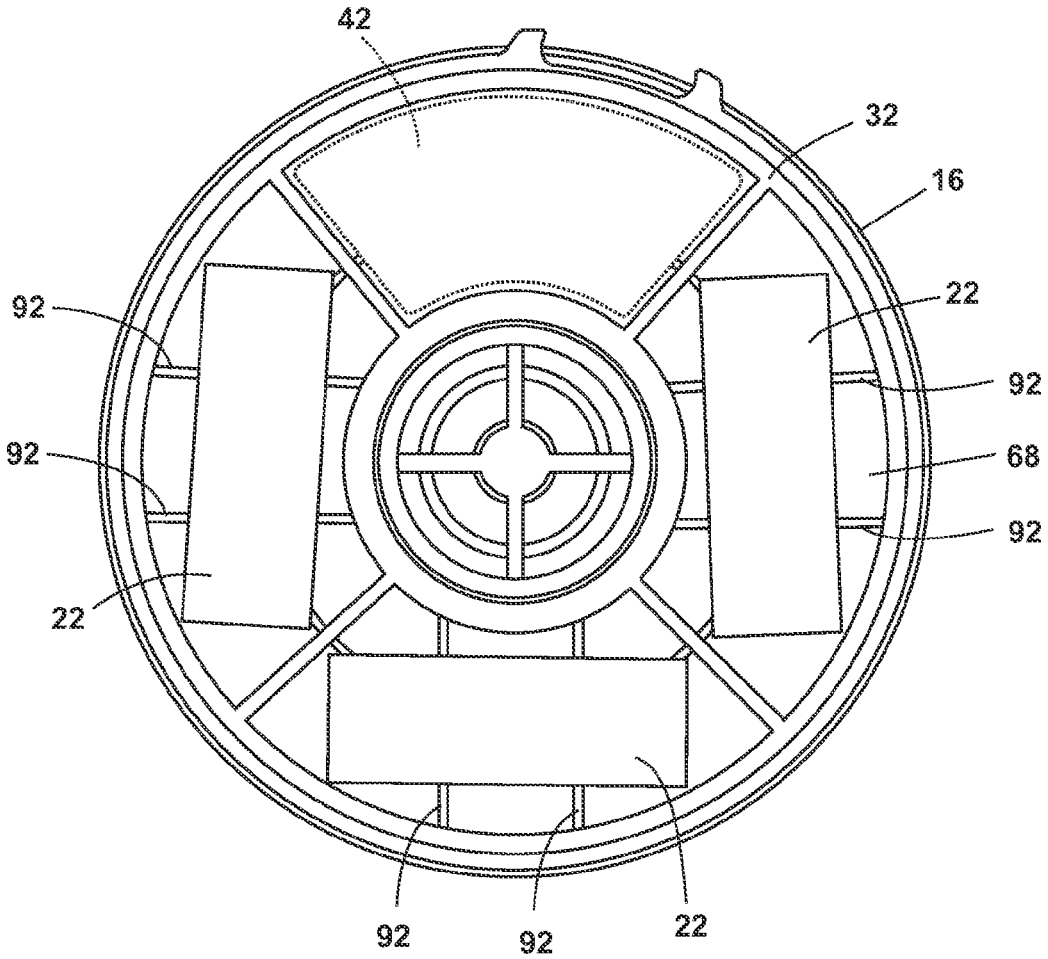
FIG. 3 is a sectional view of the PAPR module taken along line 3-3 of FIG. 2.

Referring to FIG. 3, a controller 42 is located on the face 68 of the lower body cover 32. The controller 42 monitors the speed of the centrifugal fan 26 and controls the motor 24 speed in response to the monitored fan speed to ensure a substantially constant flow rate through the PAPR module 10. Control of the motor 24 by this method provides the ability to maintain a minimum flow rate between the inlet 18 and outlet 20 openings, even when an air filter in line with the inlet 18 is partially clogged. The controller is connected to a speed sensor (not shown) that senses that rotational speed of the motor shaft, compares the sensed speed to a predetermined speed set in the controller and adjusts the power to the motor so that the sensed speed matches the predetermined. To this end, the controller has a power supply circuit that is connected to the batteries and is also connected to the motor to control the current supplied to the motor. The power switch 66 is slidable between open and closed position to controls the power supplied by the batteries to the controller 42.

The controller 42 can further be configured to store a simplistic and limited amount of data, with possible received inputs from the motor 24 and the power source 22. Operational data, such as the voltage of the power source 22 can be measured and monitored.

Referring to FIGS. 2 and 3, the upper body 14 and lower body cover 32 together form an enclosed space 90 in which the power source 22 can be located. The power source provides power at least to the motor 24 and the controller 42.

The power source 22 is typically one or more rechargeable batteries 22. The batteries 22 are received within cradles 92 formed on the face 68 of the lower body cover 32 and spaced annularly about the threaded filter connector 64. The upper body 14 serves as a lid to enclose the batteries 22 located within the cradles and can optionally be removable to gain access the batteries 22. The batteries 22 can be configured to provide power to the motor 24 for up to eight hours of continuous run time.

Figure 4A:
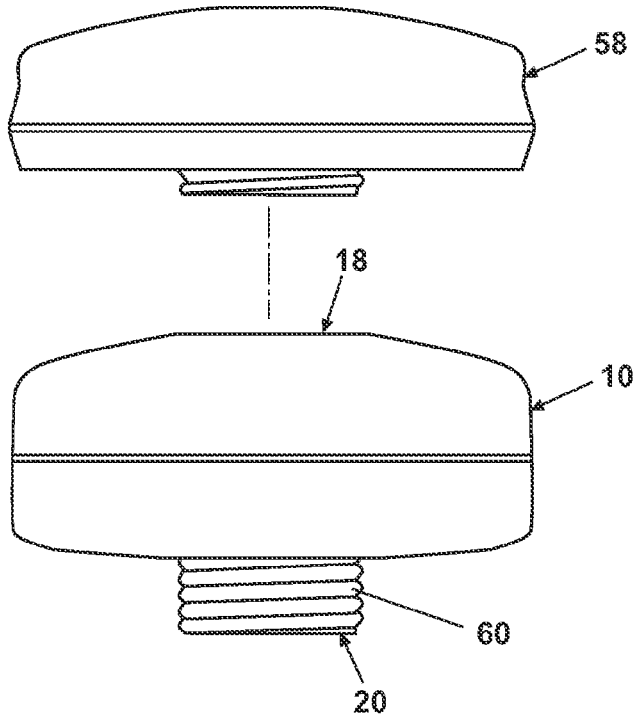
FIG. 4A is an exploded view of the PAPR module of FIG. 1 and a filter.
Figure 4B:
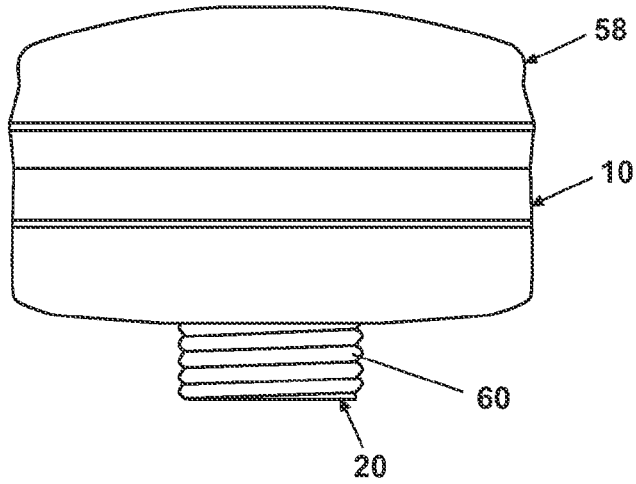
FIG. 4B is a perspective view of the PAPR module of FIG. 1 coupled to a filter.
Figure 5:
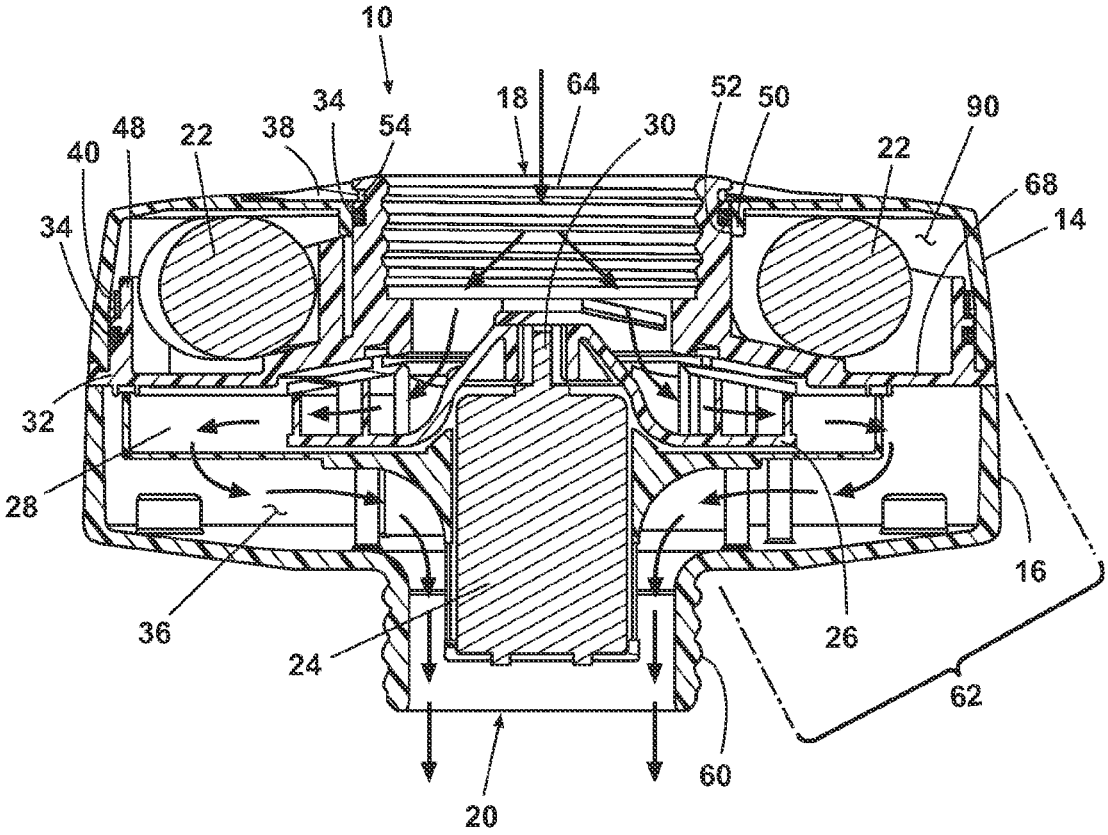
FIG. 5 is a cross-sectional view of a PAPR module of FIG. 1 illustrating an air flow path.

As shown in FIGS. 4A and 4B, the PAPR module 10 can be coupled to an air filtering means, such as a canister filter 58. The attachment is made by threading the externally threaded canister filter 58 to the internally threaded filter sleeve 64 at the inlet 18 of the PAPR module 10. The canister filter 58 typically will include filtration beds for filtering particulate material and/or gaseous material and can be selected comprising various filtering materials according to the user's intended environment. Suitable filter beds are disclosed in the U.S. Pat. No. 7,213,595, which is incorporated herein by reference. The PAPR module 10 can be selectively configured to couple with both traditional and conformal canister filters, one type of which is disclosed in U.S. Pat. No. 7,311,764. The PAPR module 10 can be configured to couple with a filter canister having a standard 40 mm thread, or other standard threads Referring to FIG. 5, an air flow path of the PAPR module 10 is illustrated. As described above, power to the PAPR module 10 can be turned on and off by means of the power switch 66. When powered on, unfiltered ambient air is drawn through an air filter 58 and into the inlet 18 of the PAPR module 10 by the centrifugal fan 26. The centrifugal fan 26 propels the air radially and the scroll 28 then spirally directs the pressurized air toward the outlet 20 of the PAPR module 10 and to the user wearable respiration protection device.

Figure 6:
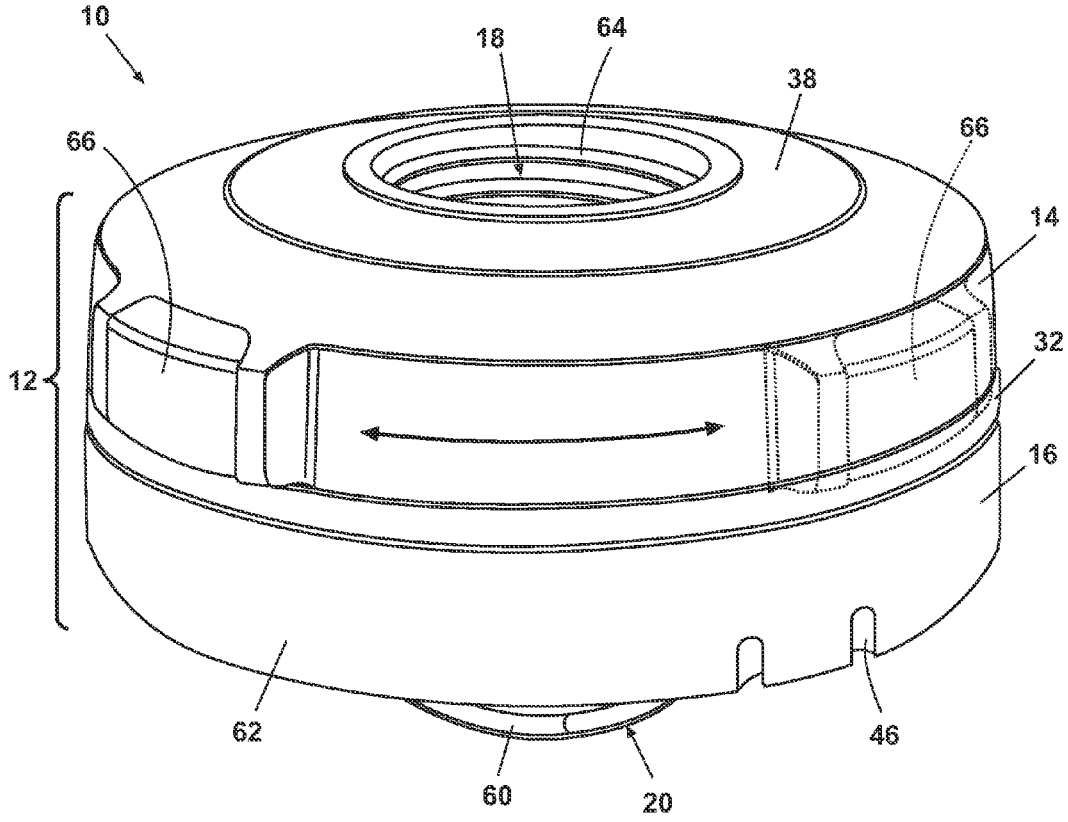
FIG. 6 is a perspective view of a PAPR module according to a second embodiment of the invention.

Referring to FIG. 6, a second embodiment of the PAPR module 10 according to the present invention is illustrated, where similar elements from the first embodiment are labeled with the same reference numerals. In this embodiment, the PAPR module 10 includes an integral power switch 66, which is located on the exterior of the upper body 14. The power switch 66 can be optionally oriented for either right or left handed users by rotating the upper body 14 on the lower body cover 32. The seals 34 maintain contact during the rotation of the upper body 14 while the lid retaining clip 38 keeps the upper body 14 retained to the PAPR module 10. Electrical contact is maintained throughout rotation by a switch contact track 40 that is made of conductive material and is located along the circumference of the lower body cover 32. The switch contact track 40 is continuous about the entire circumference, allowing the power switch 66 to maintain electrical contact at any degree of rotation. Alternatively, limited rotation of the power switch 66 and upper body 14 could be achieved through other suitable methods, such as maintaining electrical contact by means of a wire connection.

Figure 7:
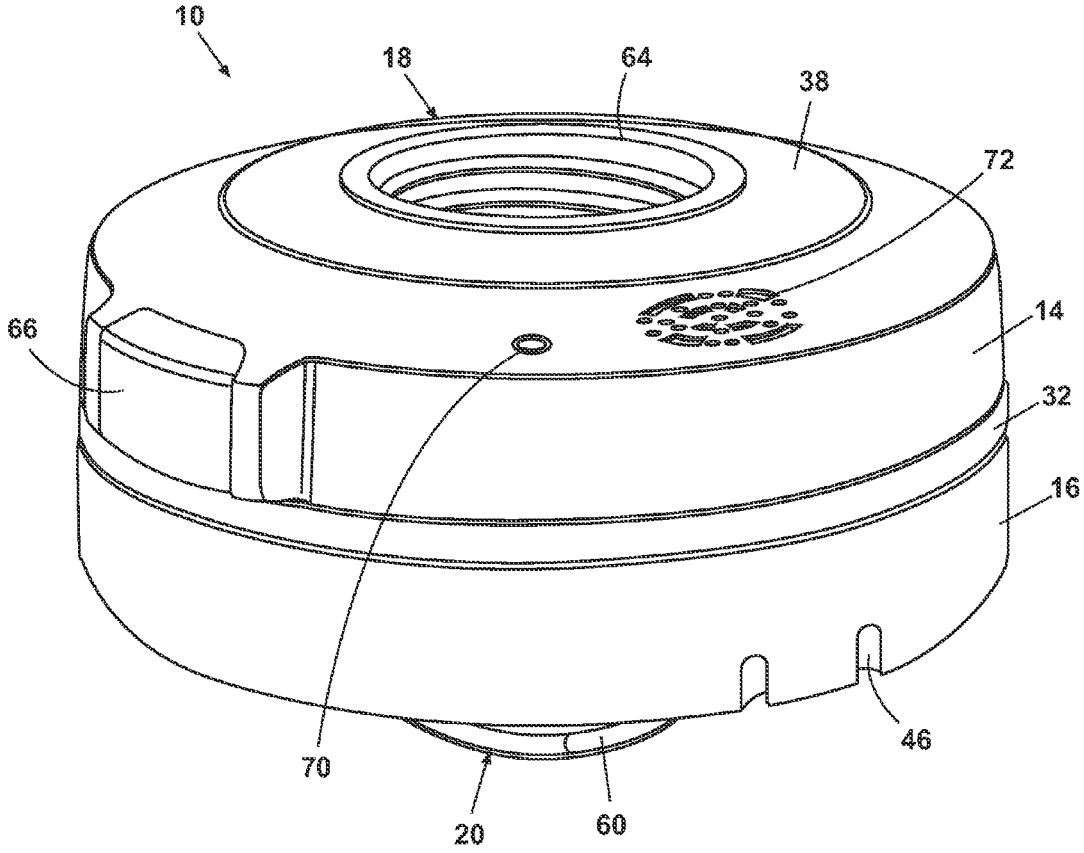
FIG. 7 is a perspective view of a PAPR module according to a third embodiment of the invention.

Referring to FIG. 7, a third embodiment of the PAPR module 10 according to the present invention is illustrated, where elements similar to those from the first embodiment are labeled with the same reference numerals. In this embodiment, the PAPR module 10 includes a user warning system comprised of a light 70 and/or an audible alarm 72 used to indicate to the user the operational status of the PAPR module 10. The controller (not shown) can use the stored data to switch on the light 70 and/or actuate the audible alarm 72 to indicate, for example, a condition of low air flow and/or low battery power. The optional light 70 can be positioned any-where on the PAPR module such that the light 70 is visible to the user. One contemplated location for the light 70, shown in FIG. 7, is on the outer surface of the upper body 14. Another contemplated location for the light 70, also shown in FIG. 7, is extending around the circumference of the PAPR module 10. For the latter contemplated location, the portion of the lower body cover 32 exposed between the upper and lower bodies 14, 16 can comprise an integrated light pipe serving as the light 70. This location may be preferable, since the light 70 is visible from more directions.

Figure 8:
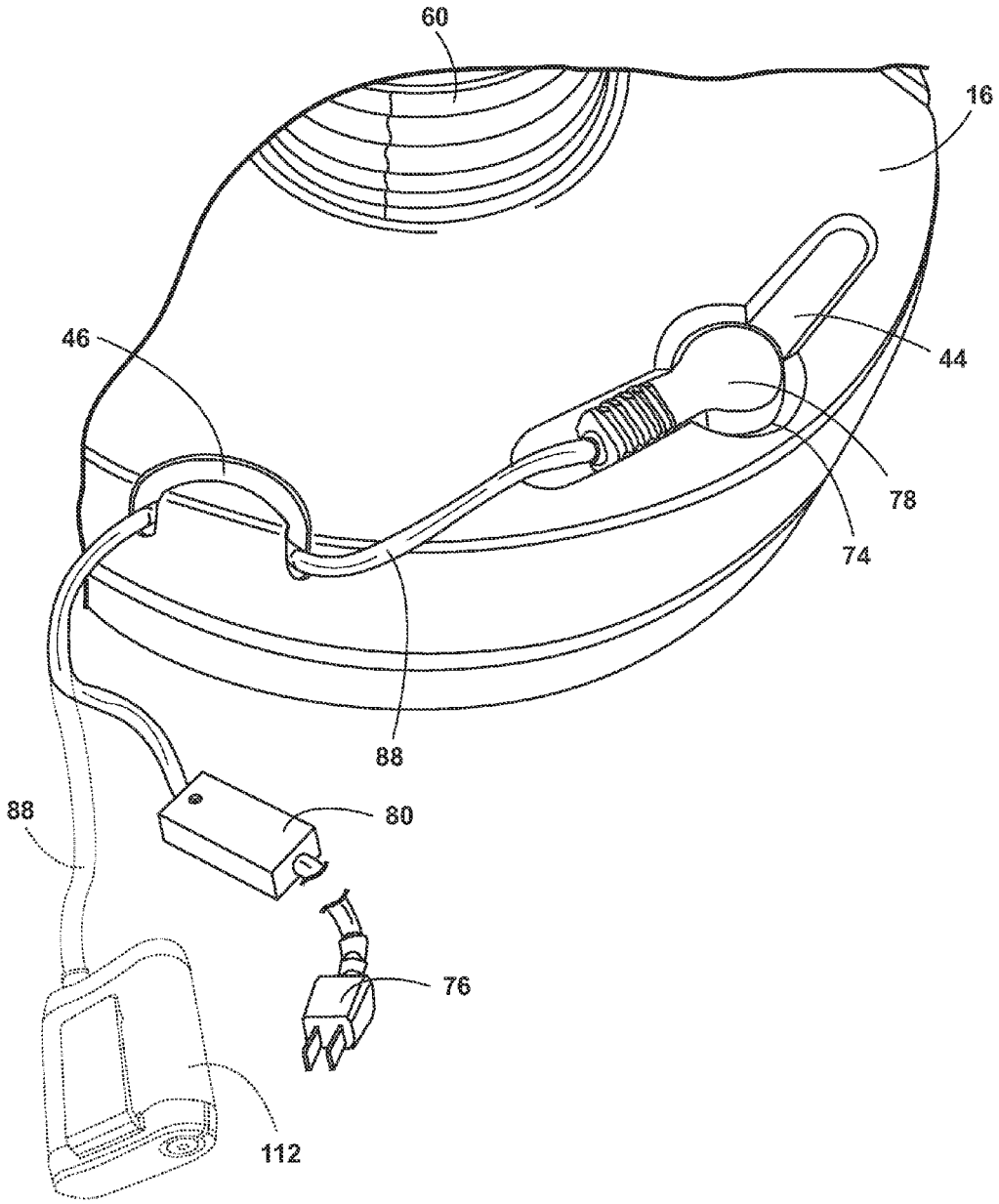
FIG. 8 is a detail view of a PAPR module of FIG. 1 according to a fourth embodiment of the invention and showing an optional remote switch.

Referring to FIG. 8, a fourth embodiment of the PAPR module 10 according to the present invention is illustrated, where similar elements from the first embodiment are labeled with the same reference numerals. In this embodiment, the PAPR module 10 includes a cable management feature and an interface port 74 by which the enclosed rechargeable batteries 22 may be charged. Charging of the batteries 22 is accomplished by affixing to a socket on the interface port 74 a complementary plug 78 of an AC charger 76. Further, the AC charger 76 can be attached to the socket of the interface port 74 and to an AC outlet to provide a power source for the PAPR module 10. Optionally, an external battery pack 80 can be connected to the PAPR module 10 through the interface port 74. The external battery pack 80 can provide power to the PAPR module 10 for extended use, up to, for example, twelve hours or more of run time. When the external battery pack 80 is plugged into the interface port 74, the PAPR module 10 is powered first by the battery pack 80; upon depletion of the battery pack 80, the system "hot-swaps" to run for additional time, now powered by the internal batteries 22. A warning light 70 signals to the user that the battery pack 80 is close to depletion, and the PAPR module 10 is automatically switched to the internal batteries 22 when depletion of the battery pack 80 does occur. An alarm can also sound to additionally signal to the user that the battery pack 80 is close to depletion, and that a "hot-swap" is about to occur. The AC charger 76 and external battery pack 80 can be two separate components, or can be combined into one multi-purpose component.

Furthermore, the interface port 74 can function as a multi-purpose communication port to the PAPR module 10. The interface port 74 can be configured to provide inputs, for example to disable the audible alarm in desirable situations. Data stored by the controller 42 can also be uploaded to a remote computer through the interface port 74 to provide information, for example, of run time or activation of the warning system.

The cable management function is provided by a plug cavity 44 and a crescent groove 46. The interface port 74 is located at approximately the center of the plug cavity 44 the plug 78 can be inserted into the interface port 74 along the plug cavity 44 in either of two directions. The plug cavity 44 can thus be used for either right or left handed orientation. The crescent groove 46 is formed on the surface of the lower body 16 periphery and is spaced from the plug cavity 44. The crescent groove 46 is formed to receive and retain a cable 88 extending from the plug 78. The cable 88 is inserted into the crescent groove 46 to keep the plug 78 from being dislodged from the interface port 74. There are multiple crescent grooves 46 on the lower body 16 surface to further aid in selectively orienting the plug 78 for either right or left handed users.

The PAPR module 10 can be designed for extended use or for one-time use, after which the PAPR module 10 may be discarded, depending on the economics of the prospective use. For an extended use model, the PAPR 10 can utilize components with longer use lives, and may be higher cost components, such as a precious metal brushed motor 24 and rechargeable lithium-ion batteries for the power source 22. For a one-time use model, the PAPR module 10 can utilize components that do not have to be used more than one, and may be lower cost components, such as a less expensive motor 24 with a lower life expectancy or durability and alkaline batteries for the power source 22. The one-time use model can also be made available to the consumer with a filter 58 bonded to the PAPR module 10, and packaged in a sealed package to be opened by the user at the time of need.

Figure 9:
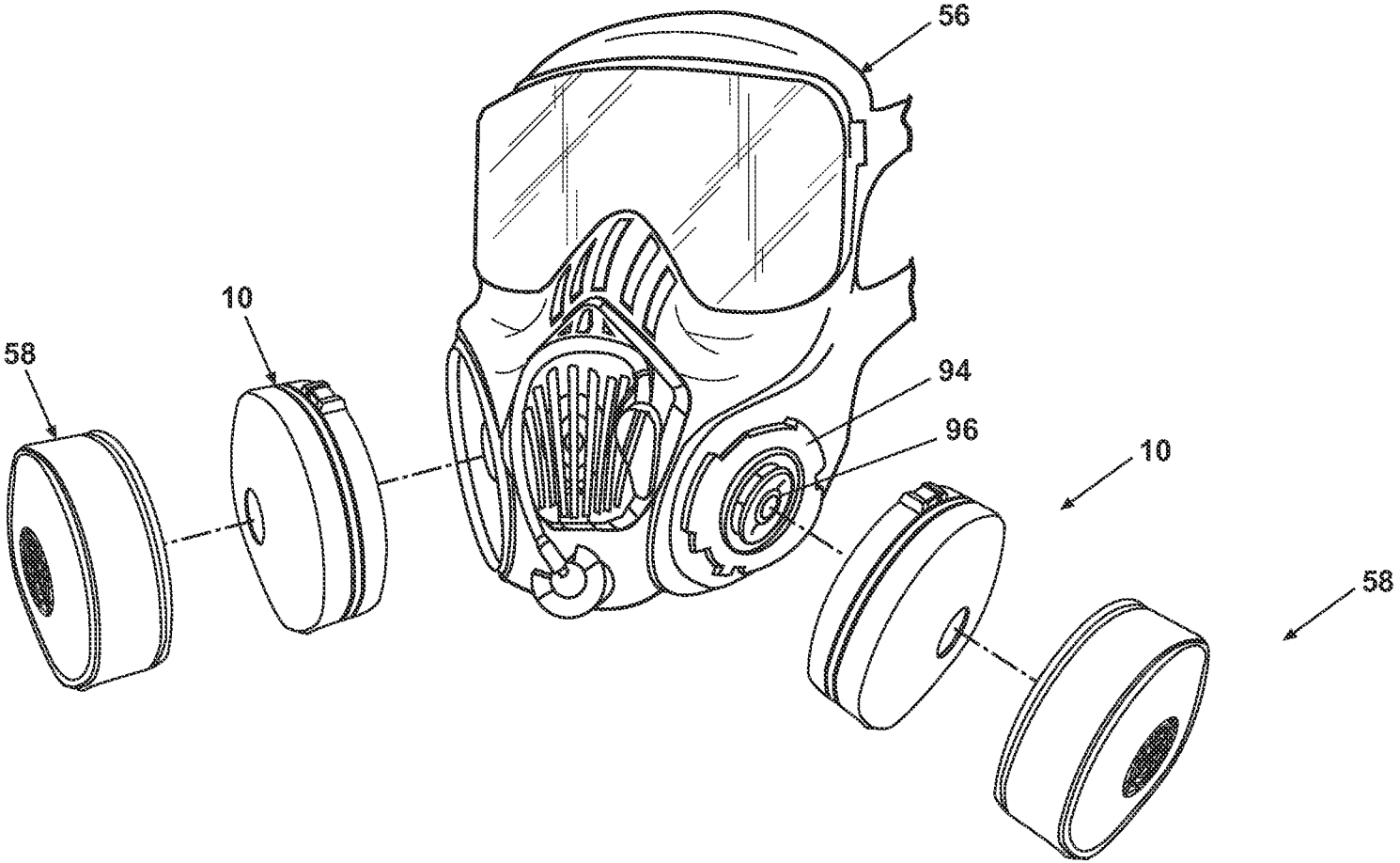
FIG. 9 is a perspective view of a PAPR module of FIG. 1 illustrating a mask mounted use configuration.

The PAPR module 10 can be employed in multiple different use configurations. Referring to FIGS. 9-D, four exemplary use configurations are illustrated. FIG. 9 shows the PAPR module 10 mounted to a mask facepiece 56. A filter canister 58 can be attached to the PAPR module 10, as described above, and the PAPR module 10 can be attached to the mask facepiece 56 at an inlet valve 96 as disclosed, for example, in U.S. Pat. No. 7,213,595. Attachment to the mask facepiece 56 is made by threading the externally threaded mask sleeve 60 at the outlet 20 of the PAPR module 10 to an internally threaded inlet (not shown) of the mask facepiece 56. Alternatively, the PAPR module can have a bayonet attachment as disclosed in U.S. Pat. No. 7,213,595 and the mask facepiece can have a complementary bayonet attachment 94 for a quick attachment. In similar manner both the inlet opening 18 of the PAPR module and the outlet opening of the filter canister 58 can have complementary bayonet fixtures for quick attachment and detachment of the filter canister 58 from the PAPR module 10.

Figure 10:
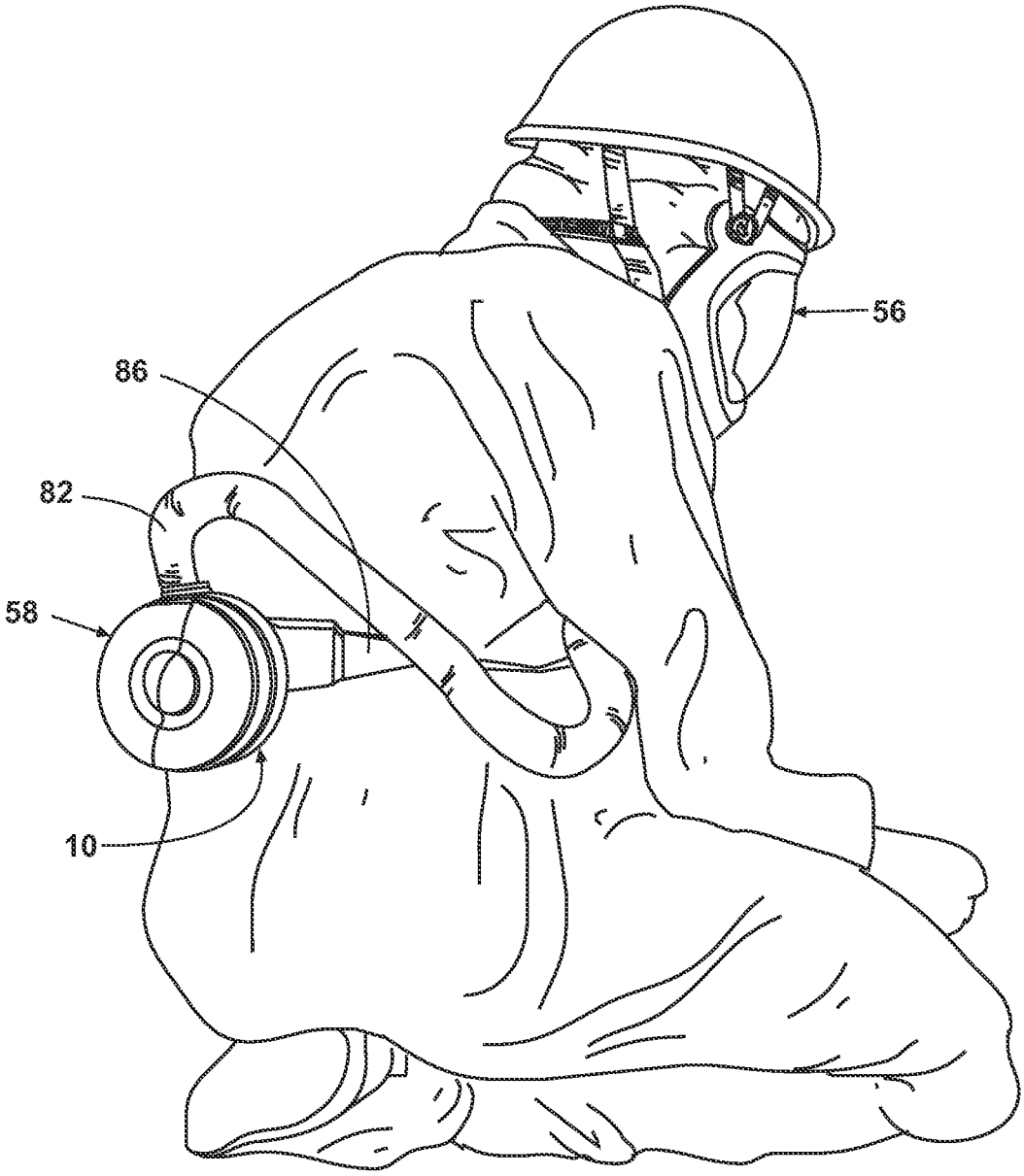
FIG. 10 is a perspective view of the PAPR module of FIG. 1 illustrating a remote use configuration.

In another configuration, as shown in FIG. 10, the PAPR module 10 is shown mounted to a belt 86 worn on the waist, back, or other body location of a user for use with an air hose 82 between the modular PAPR 10 and a mask facepiece 56. One end of the hose 82 is fixedly attached to the PAPR module 10 utilizing the above mentioned interconnecting threads and the other end extends to the user's mask facepiece 56 or a hood. A filter 58 is attached to the PAPR module 10 inlet 18, as described above.

Figure 11:
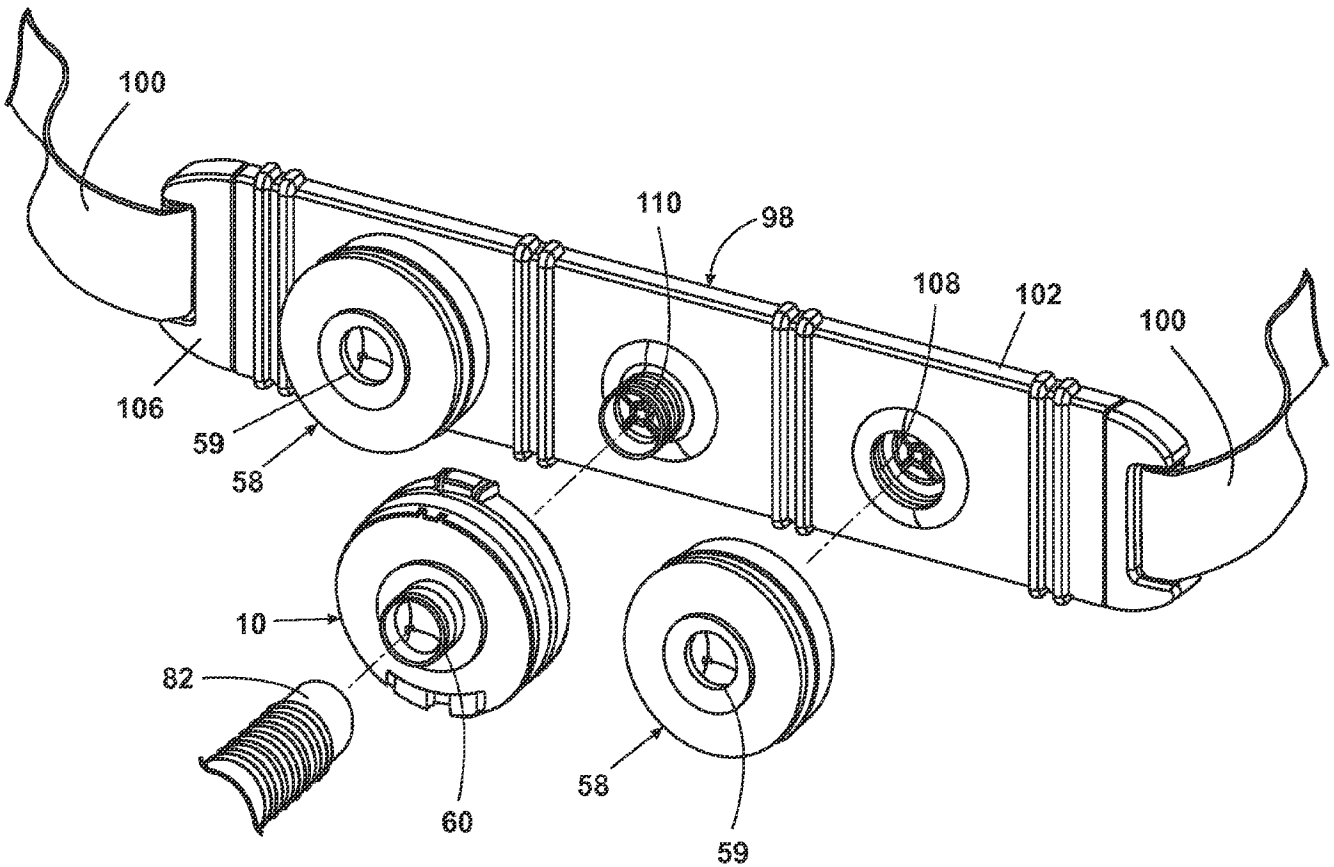
FIG. 11 is a perspective view of the PAPR module of FIG. 1 illustrating a remote use configuration utilizing a plenum belt.

In yet another configuration, as shown in FIG. 11, the PAPR module 10 is shown mounted to a plenum belt 98 to be worn on the waist, back, or other body location of a user for use with an air hose 82 between the modular PAPR 10 and a mask facepiece 56. The plenum belt 98 comprises a flexible hollow plenum 102 and two belt straps 100, and includes a plurality of threaded openings 108, for example, two threaded openings and a third opening formed by a threaded sleeve 110. The inlet 18 of the PAPR module 10 can be attached to the plenum belt 98 through the threaded sleeve 110 and the outlet 20 can be attached to a hose 82 through the threaded sleeve 60 in fluid communication with the user's mask facepiece 56. Attachment of the PAPR module 10 to the plenum belt 98 can be made by threading the internally threaded filter sleeve 64 at the inlet 18 of the PAPR module 10 to the externally threaded sleeve 110 on the plenum belt 98. The hose 82 is attached to the PAPR module 10 and a user's mask facepiece 56 or hood as described above. At least one filter canister 58 having an inlet opening 59 can be attached to the plenum belt 98 by threading the externally threaded filter canister 58 to an internally threaded opening 108 on the plenum belt 98. The above mentioned attachments can alternatively have a bayonet attachment as disclosed in U.S. Pat. No. 7,213,595.

In the above configuration, as shown in FIG. 11, air is drawn by the PAPR module 10 through the openings 59 in the canister filters 58 and into the plenum belt 98. Filtered air then enters the PAPR module 10 from the plenum belt 98 and is passed through the PAPR module 10 to the hose 82. The filters that are attached to the belt to meet certain conditions, such as heavy industrial/infection control and CBRN, The belt can be strapped to a SCBA tank or worn as a bandolier. Convention and conformal filters can be mounted to the belt. Thus the belt provides a user with flexibility for many different conditions to protect against CBRN (chemical, biological, radiological, and nuclear) hazards by utilizing CBRN filters. The plenum belt 98 can be made of a thermoplastic elastomer, such as a butyl material for agent resistance, ethylene propylene diene monomer rubber, or any other suitable material.

In both the remote, or belt-worn, configurations shown in FIGS. 10 and 11, a remote switch 112 can be advantageously used to remotely power on/off the PAPR module 10 when it is worn on the back, or other location, as shown in FIG. 8. The remote switch 112 plugs into the interface port 74, in similar fashion as described above, and can also be configured to provide the user with information, such as run time or battery life indication, for example. The remote switch 112 can be clipped to the user's belt or other object, could be carried in the user's pocket, or any other suitable means or method. The remote switch 112 beneficially allows the user easy access, without having to remove the belt, to power the PAPR module 10 on or off when it is located in a hard to reach location, such as the user's back.

Figure 12:
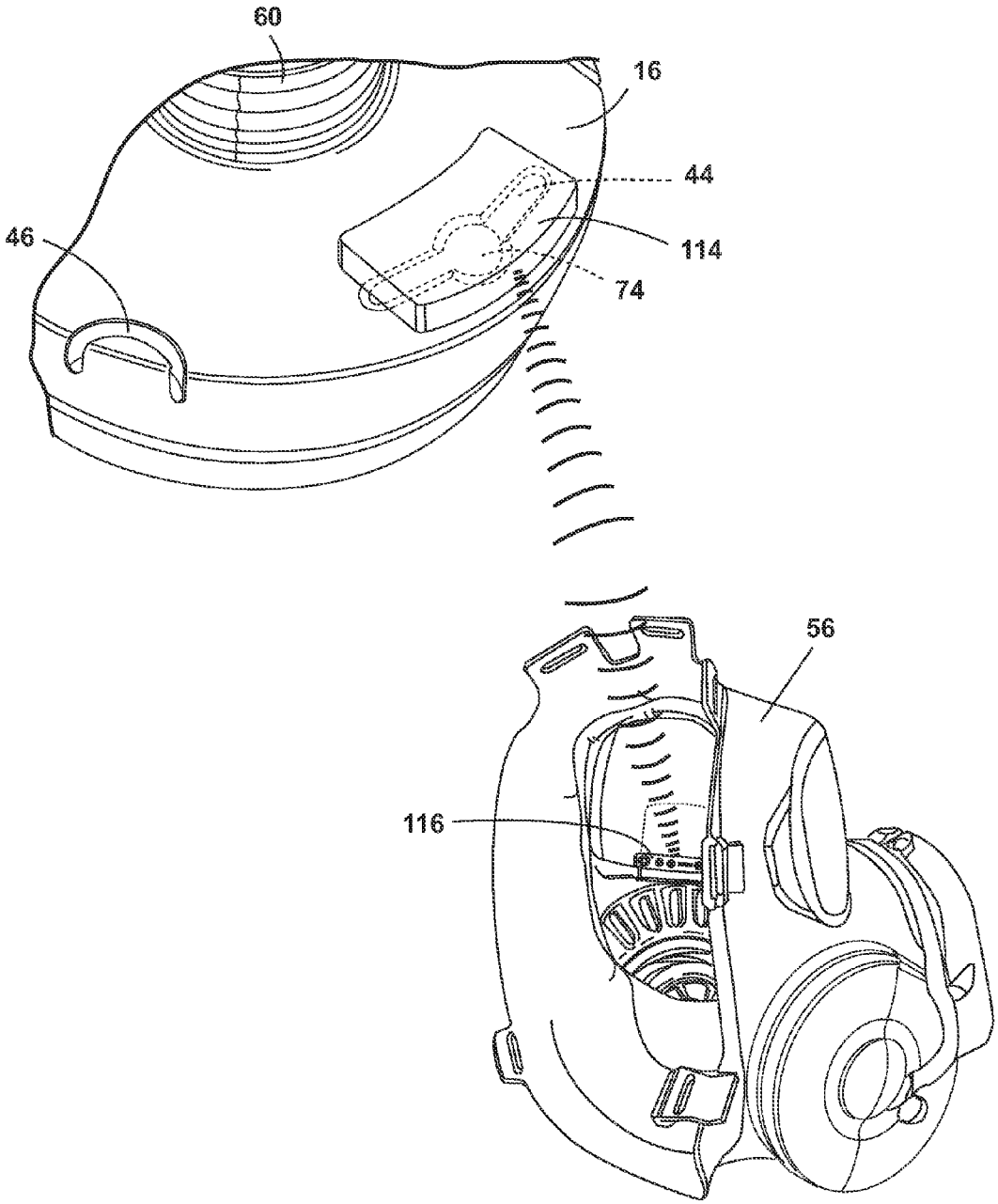
FIG. 12 is a detail view of a PAPR module of FIG. 1 illustrating a wireless heads up display feature utilizing a transmitter and mask.

Referring to FIG. 12, a fourth user configuration is shown where the PAPR module 10 can be used with a wireless transmitter 114 that can be affixed to the interface port 74 for wireless communication to a heads up display module 116 located in the user's facepiece 56 or hood. The heads up display can be mounted in the facepiece 56, and can display operational information, such as run time or battery power level, for example, to be viewed by the user on the inside of the facepiece 56. The heads up wireless transmitter 114 and display module 116 can be used with both a mask mounted PAPR module 10 and a belt or remote mounted PAPR module 10.

One of the most significant benefits the PAPR module 10 provides is the ability to modularize the respirator system. Depending on several variables, such as the hazard to protect against or the economics of the prospective user, the PAPR module 10 can be used in several different configurations and against a variety of hazards. The same PAPR module 10 can be mounted on the user's facemask or mounted on a plenum belt 98 to advantageously protect against CBRN hazards. This modularity is unique to the disclosed invention.

To this end, the PAPR module 10 can be made available to the consumer in various kits. These kits can consist of the PAPR module 10 and multiple combinations of the accessory components, such as a hose 82, mask 56, hood, external battery pack 80, belt or harness, wireless heads up display 114, 116, battery charger 76, or filters 58. The various combinations of components within the kits can be offered to the consumer based on typical use configurations and perceived user needs.

Figure 13:
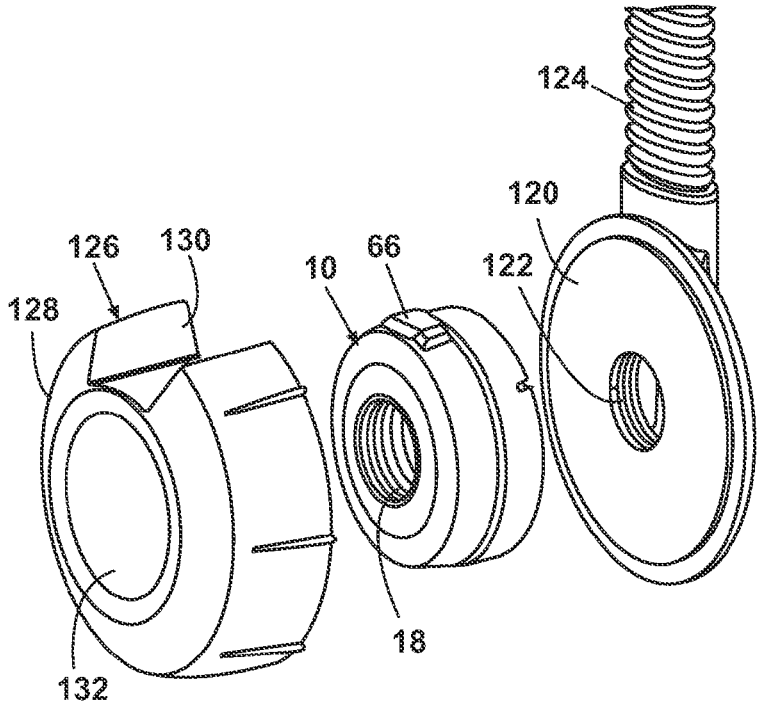
FIG. 13 is a perspective exploded view of the PAPR module of FIG. 1-3 or 6-8 in combination with a particulate filter module and a low profile hose assembly.
Figure 14:
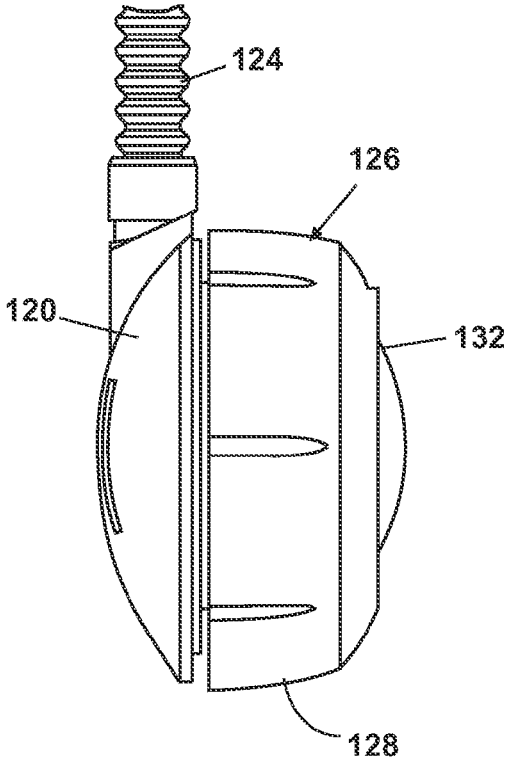
FIG. 14 is side view of the assembled PAPR module, particulate filter module and low profile hose assembly of FIG. 13.

Referring now to FIGS. 13 and 14, where like numerals have been used to identify like parts, the in-line PAPR 10 is shown in exploded view with a particulate filter 126 and a low profile hose assembly. The low profile hose assembly comprises a relatively flat plenum 120 having a threaded inlet opening 122 which threadably receives the threaded sleeve 60 of the PAPR module 10. A low profile hose 124 is connected to the plenum 120 and is in fluid communication with the threaded inlet opening 122. The annular particulate filter module 126 has an annular housing with particulate filter material therein and has a slot opening 130 which indexes with the power switch 66 of the PAPR 10. The particulate filter material can be any suitable particle filter which includes a pleated filter material commonly used in particle filters. An inlet opening 132 is in fluid communication with the particle filter within the annular housing 128. The filter module 126 further has a threaded outlet sleeve (not shown), similar to the threaded sleeve 60 of the PAPR module 10, which is threadably received in the threaded inlet of the PAPR module 10. As illustrated in FIG. 14, the annular particulate filter module 126 surrounds the PAPR 10 and has a very low profile.

Figure 15:
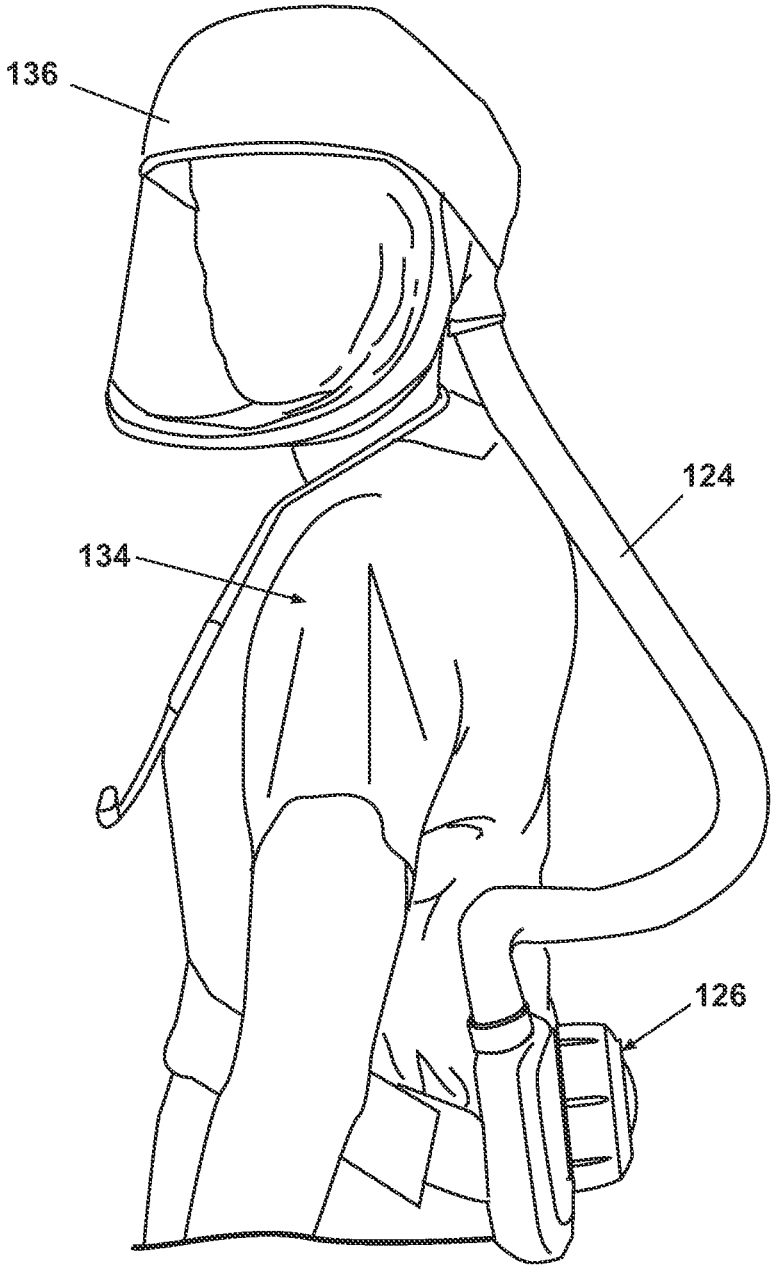
FIG. 15 is a graphical representation of the PAPR assembly of FIGS. 13 and 14 mounted on a belt and carried by a user.

The assembled low-profile particulate filter module 126, PAPR module 10 and the low-profile hose assembly can be used in a number of different applications, including a medical/infection controlled environment for high flow industrial uses such as dust markets and for infection controlled environments. Referring to FIG. 15, the particulate filter module 126 with in-line PAPR 10 and low-profile module is shown with a medical/infection control worker 134 bearing a hood 136 which is connected to the PAPR 10/particulate filter module 126 through the low-profile hose 124.

Figure 16:
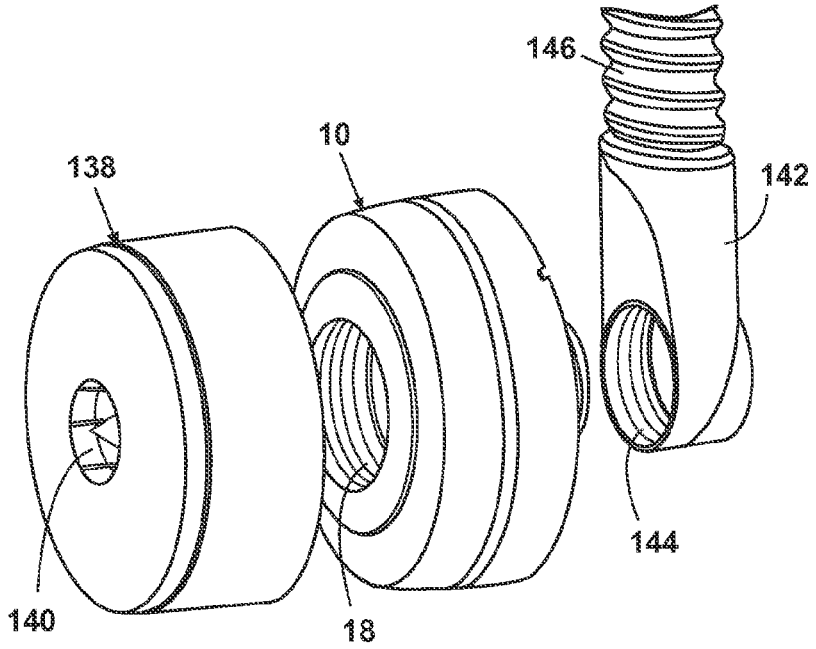
FIG. 16 is a perspective exploded view of the PAPR module of FIG. 1-3 or 6-8 in combination with a CBRN filter module and a low profile hose assembly.
Figure 17:
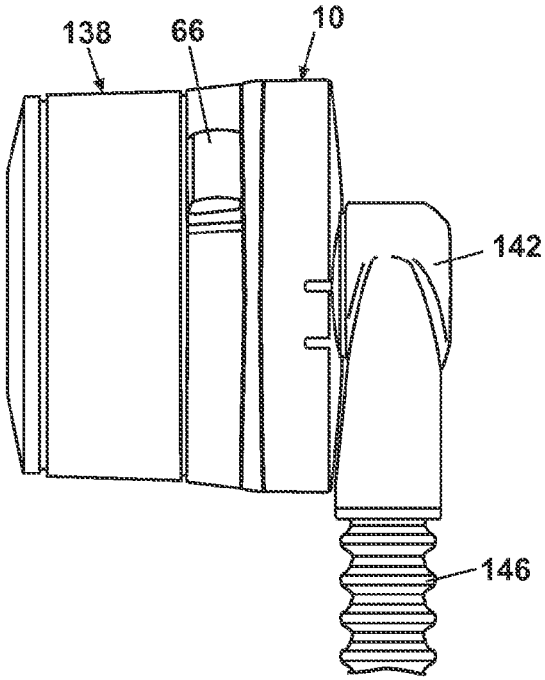
FIG. 17 is side view of the assembled PAPR module, CBRN filter module and low profile hose assembly of FIG. 16.

Referring now to FIGS. 16 and 17, a CBRN embodiment is illustrated with a CBRN filter module 138, a PAPR 10, and a hose module that includes a plenum fixture 142, a low-profile hose 146 and a threaded inlet opening 144. The threaded sleeve 60 of the PAPR 10 is threadably received in the threaded opening 144 which is in open communication with the low-profile hose 146. The CBRN filter module has the usual CBRN filter materials, which can include a particle filter as well as a particulate carbon filter. The CBRN module 138 has an inlet opening 140 as is conventional with the filter canisters of this nature. An example of a suitable filter module 138 is disclosed in U.S. Pat. No. 7,311,764, which is incorporated herein by reference in its entirety. Typically, the plenum fixture 142 as well as the plenum fixture 120, can be fitted with a belt clip or belt mounting for mounting the plenum fixture to a belt which is worn by a user The invention is applicable to a number of different applications and the PAPR module 10 can be manufactured in many different forms to suit the particular application. The PAPR can be used as an external mount of a filter on a mask area or away from the mask area, as may be required, for example in an Air Force mask. The PAPR can further be integrated into a suit for cleanup/light industrial use. Further, the PAPR can be manufactured with a breathing control unit which can maintain a predetermined airflow through the PAPR, or, alternatively, provide an adjustable control for control of the flow rate through the PAPR. Further, the PAPR can be manufactured with a switch which turns the PAPR module power on and off, depending on the needs of the user.

The invention also contemplates packaging the PAPR module with a variety of accessories which can be used for a variety of different situations. For example, one or more PAPR modules can be mounted with a belt, for example, as illustrated in FIG. 11, along with a variety of filter modules which can be used for different environmental conditions, such filter modules including a particle filter, as illustrated in FIGS. 13 and 14, a CBRN filter module, which is used for filtering toxic gases as well as toxic particles, and an auxiliary TIM filter for boosting the filter capacity of a CBRN module, for use in TIM gases. An auxiliary TIM filter module used in conjunction with a CBRN filter module is disclosed in the PCT Patent Publication WO 2001/78839 A1, which disclosure is incorporated herein by reference.

The module kit can and further include a module control unit or data collection unit which can be plugged into the PAPR module through the interface port 74, a recharging module, as illustrated in FIG. 8, which can also be plugged into the interface port 74, and an auxiliary battery unit, also illustrated in FIG. 8.

The invention provides for a very low-profile, yet highly productive and lightweight and highly adaptable module for providing filtered air to a mask, a hood or similar breathing apparatus. It can be packaged with a number of different variance for a variety of different environments which can be selected by the user for use with conventional breathing masks. It provides a very effective and lightweight module which can be operated with internal batteries, solely on an external battery, or a combination of the two with a hot swap circuit over extended periods of time.

Figure 18:
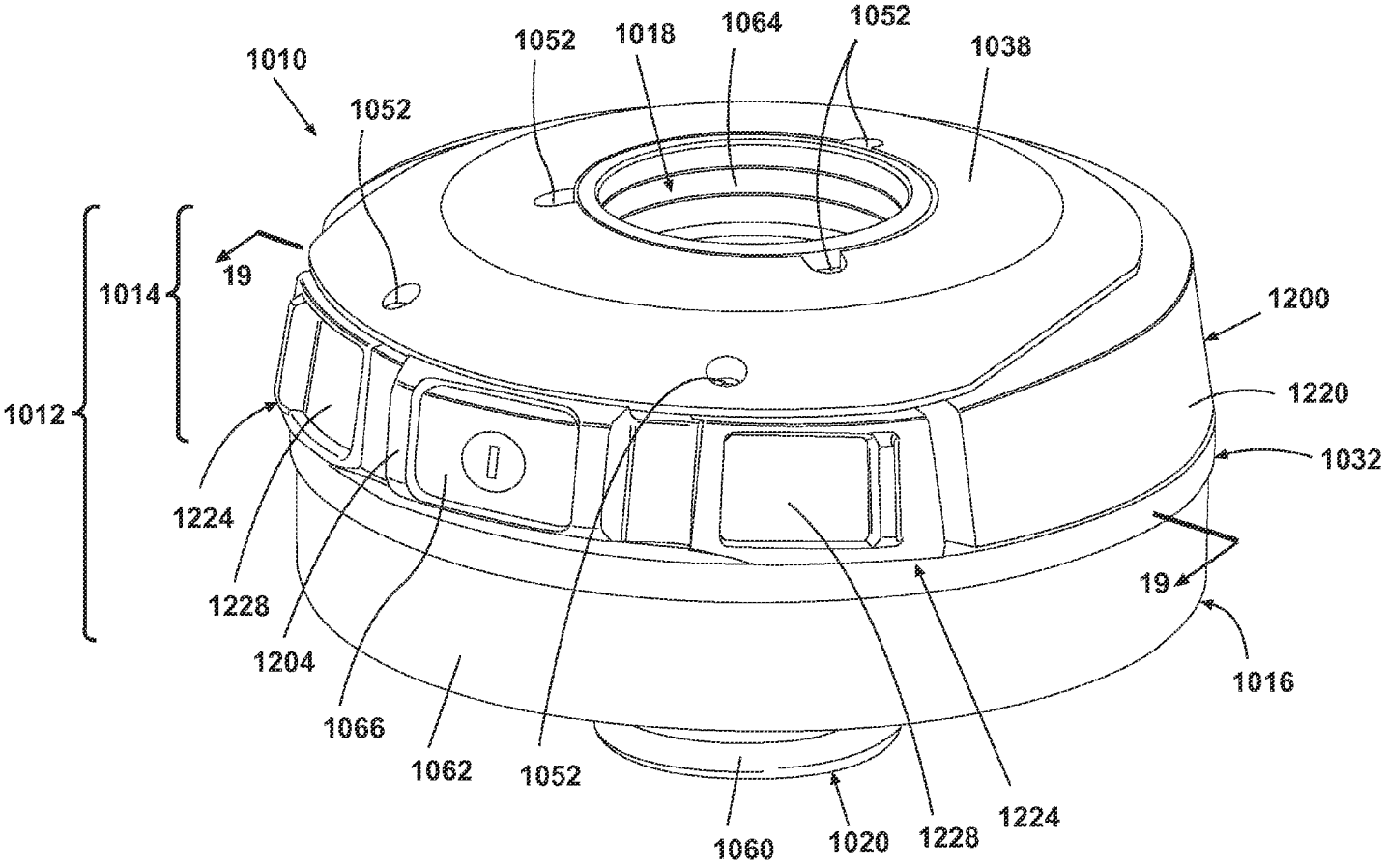
FIG. 18 is a perspective view of a PAPR module comprising a removable battery pack module according to another embodiment of the invention.
Figure 19:
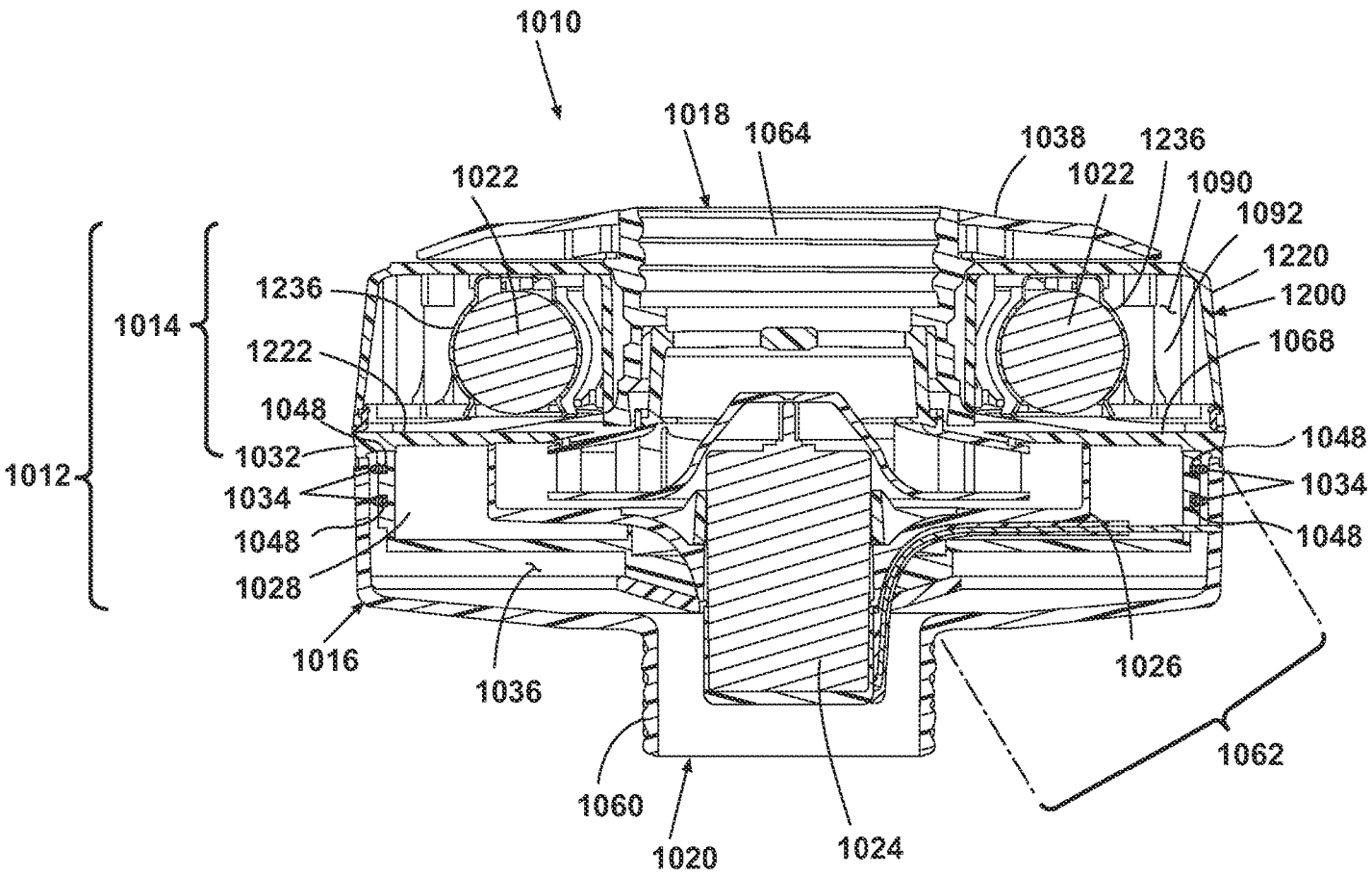
FIG. 19 is a cross-sectional view of the PAPR module and battery pack module of FIG. 18 taken along line 19-19 of FIG. 18.

Referring to FIGS. 18 and 19, a fifth embodiment of a powered air purifying respirator (PAPR) module 1010 comprises a removable battery pack module 1200. The PAPR module 1010 is a self-contained, compact unit, and generally comprises a motor 1024, a fan 1026, a scroll 1028, and a power source 1022 all within a single unit. The PAPR module 1010 has an inlet opening 1018 that can be attached to an air filtering means (not shown), and an outlet opening 1020 that can be attached to a user-wearable respiration protection device, such as a facepiece of a respirator mask (not shown) or to a conduit (not shown) that is fluidly connected to a facepiece inlet opening in a respirator mask. The PAPR module 1010 can be considered an "in-line" PAPR, wherein the inlet opening 1018 and outlet opening 1020 are coaxially aligned, such that the direction of inlet and outlet airflow is generally parallel to the center axis of the PAPR module 1010.

The PAPR module 1010 comprises a main housing 1012 made of two cylindrical portions, an upper body assembly 1014 and a lower body 1016. The lower body 1016 is circular in cross-sectional configuration, although other cross-sectional configurations are possible, and comprises two contiguous segments, a main lower body 1062 and a releasable mounting connector 1060. The outlet 1020 is defined by the releasable mounting connector 1060, which is advantageously used to couple the PAPR module 1010 to a user-wearable respiration protection device, such as a facemask.

Figure 20:
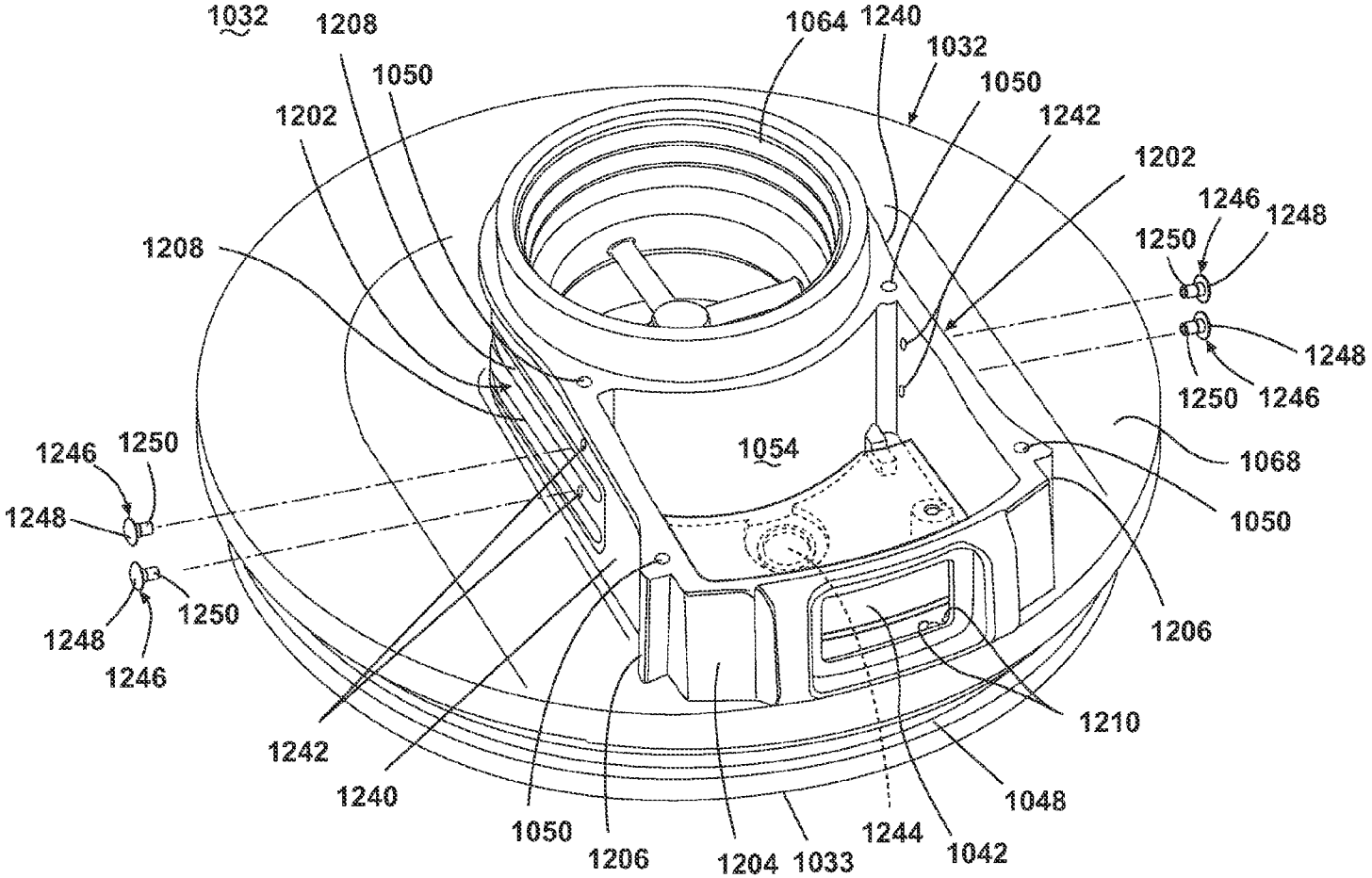
FIG. 20 is a perspective view of a lower body cover of the battery pack module of FIG. 18.
Figure 21:
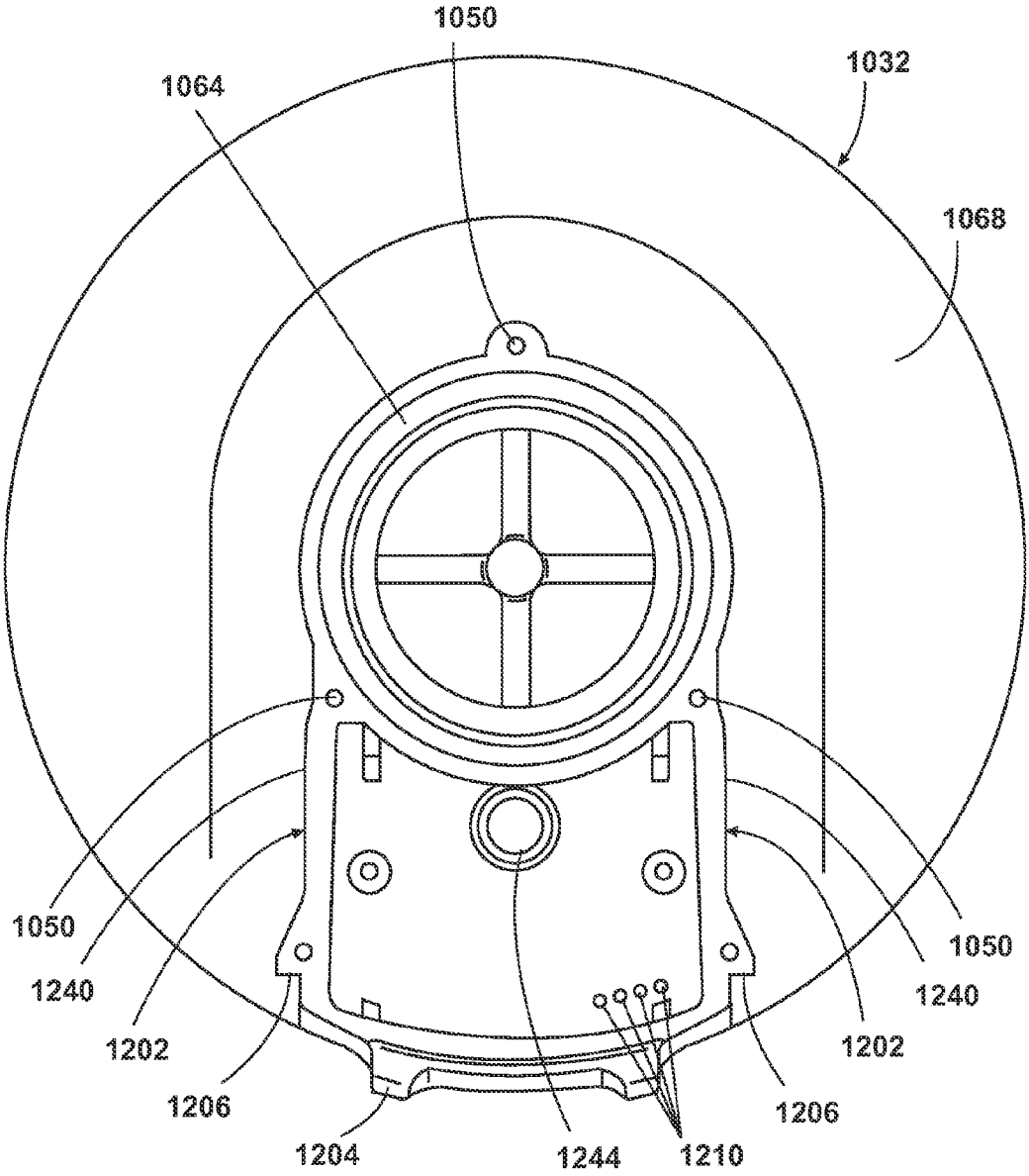
FIG. 21 is a top view of the lower body cover of FIG. 20.

Referring additionally to FIGS. 20-21, positioned over the open end of the lower body 1016 is a lower body cover 1032 that comprises a downwardly depending skirt 1033. The skirt 1033 extends down into the lower body 1016 and is positioned circumferentially adjacent and interior to the lower body 1016. Two spaced O ring seals 1034 (FIG. 19) are positioned in corresponding grooves 1048 located on the skirt 1033. The O rings 1034 are positioned at the interface between the lower body 1016 and the lower body cover 1032 to form a seal between the two components. The O ring seals 1034 are circular and can be made of any suitable elastomeric material. The lower body cover 1032 is affixed in air-tight fashion to the lower body 1016 by welding, or any other suitable means. Together, the lower body 1016 and lower body cover 1032 form an enclosed space to define a sealed breathing zone 1036 that is in fluid communication with the inlet opening 1018 and the outlet opening 1020. Thus, only air which has passed through an air filter canister attached to the inlet opening 1018 can pass to a respirator through the outlet opening 1020.

An internally threaded filter sleeve 1064 extends upwardly from a face 1068 of the lower body cover 1032 opposite the sealed breathing zone 1036. The threaded filter sleeve 1064 defines the inlet 1018 of the PAPR module 1010 and can be used to couple an air filtering canister (not shown) to the PAPR module 1010. The lower body cover 1032 comprises two opposed ribs 1202 that are located on the face 1068 of the lower body cover 1032. The ribs 1202 originate at a generally tangential position with respect to the threaded filter sleeve 1064 and extend toward the perimeter of the lower body cover 1032. The distal ends of the ribs 1202 are joined by a circumferential outer wall, referred to as a switch wall 1204. A catch, defined as lip 1206, projects outwardly from each rib 1202 and is positioned inward of the intersection between the ribs 1202 and the switch wall 1204.

The lower body cover 1032 further comprises at least one groove 1208 that extends a portion of the length of the rib 1202. In the illustrated embodiment, two groves 1208 are shown, the grooves 1208 being spaced and parallel. The grooves 1208 are located on an outer vertical face 1240 of each rib 1202. An aperture 1242 is located in each of the grooves 1208 and passes through the width of the rib 1202. An exposed rivet terminal 1246 is positioned in each of the apertures 1242. The rivet terminal 1246 comprises a head 1248 and a tail 1250 and is oriented so that the head 1248 is positioned adjacent the outer vertical face 1240, and the tail 1250 protrudes from the interior of the rib 1202. This orientation is repeated for each of the rivet terminals 1246. In the illustrated example, there is shown four grooves 1208, four apertures 1242, and four rivet terminals 1246, however more or fewer of these components is feasible.

The PAPR module 1010 also includes a power switch 1066, which is mounted in the switch wall 1204 of the lower body cover 1032. The power switch 1066 is electrically connected to the electrical system.

The area bounded by the two ribs 1202, switch wall 1204, and filter sleeve 1064 define a controller chamber 1054 within which a controller 1042 is mounted. A series of through holes 1210 are made through the face 1068 and are located within the controller chamber 1054. These holes 1210 are adapted for electrical wiring (not shown) to pass therethrough for electrically connecting the controller 1042, motor 1024, and the electrical system. An opening 1244 is also located on the face 1068 within the controller chamber 1054. The opening 1244 is covered with a lens (not shown), and the controller 1042 optically monitors the speed of the fan 1026 therethrough. The controller can also be adapted to receive inputs from a remote source for control of the PAPR module.

Figure 22:
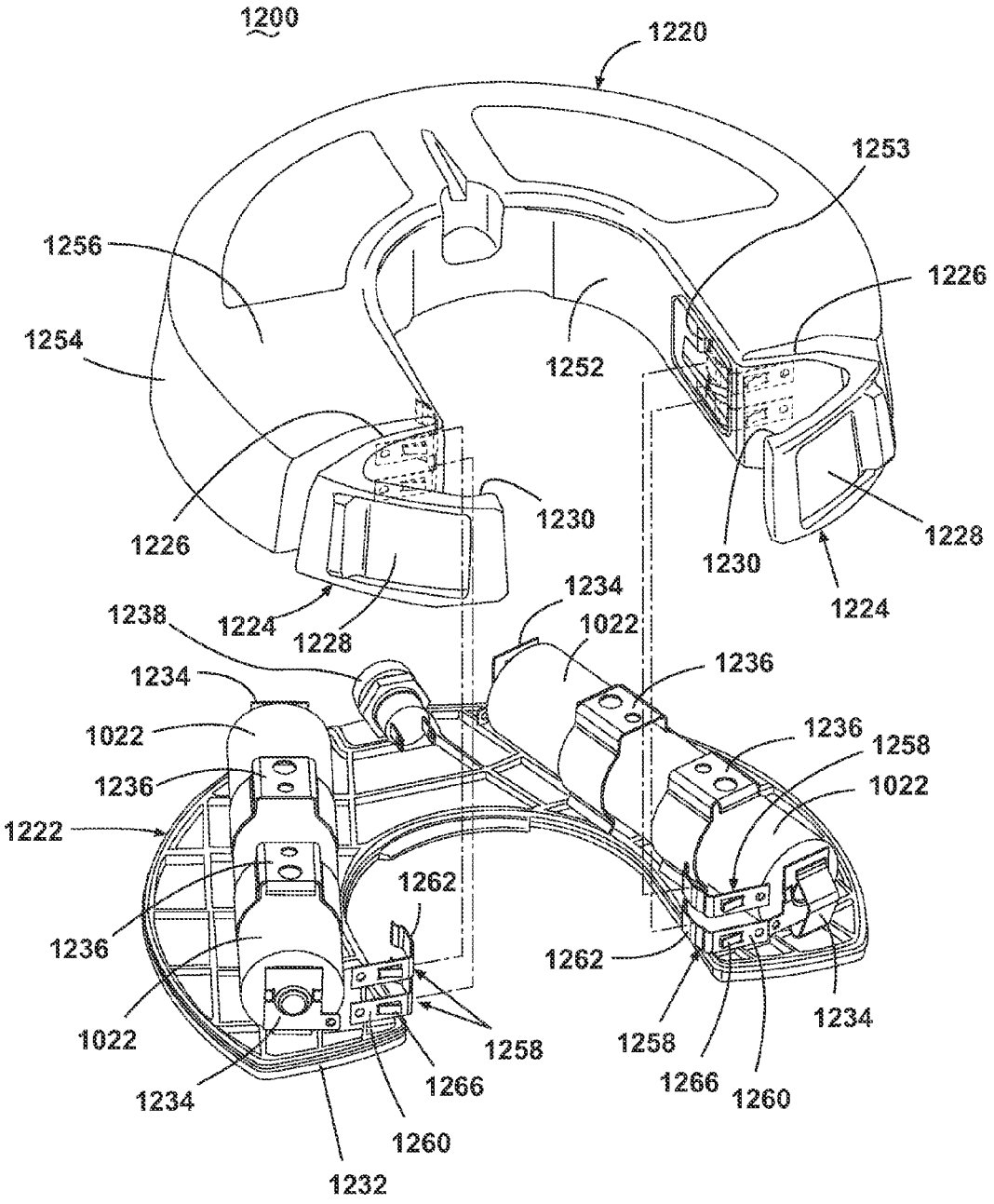
FIG. 22 is a partially exploded view of the battery pack module of FIG. 18.

Referring now to FIGS. 18 and 22, the upper body assembly 1014 comprises the removable battery pack module 1200 and a lid 1038. The upper body assembly 1014 generally has a similar cross-sectional configuration as the lower body 1016 to create the aesthetic appearance of a compact, self-contained unit. The lid 1038 is a generally circular member, having a somewhat convex outer surface, a circular cutout near the approximate center, and support structure (not shown) on the interior surface for added structural rigidity. The lid 1038 is positioned atop the battery pack module 1200 and a portion of the lower body cover 1032, and comprises a plurality of through holes 1052. The lower body cover 1032 includes a corresponding plurality of screw bosses 1050 located in the ribs 1202 and around the perimeter of the filter sleeve 1064, as is best seen in FIG. 21. The lid 1038 is affixed to the lower body cover 1032 using commonly known fasteners that pass through the holes 1052 and seat into the screw bosses 1050. Other suitable means for attaching the lid 1038 to the lower body cover 1032 are feasible.

The battery pack module 1200 comprises a battery housing 1220 and a battery lid 1222, both of which are generally U-shaped members. The cross-section of the battery housing 1220 is generally a three sided, U-shaped structure comprising an interior wall 1252 with slots 1253, an exterior wall 1254, and a top wall 1256. The interior of the battery housing 1220 comprises a plurality of ribs, mounting structure, and cradles 1092 (FIG. 19) that support the batteries 1022 (FIG. 19) and other components mounted thereto. The ends of the U-shaped battery housing 1220 terminate in an opposed pair of resilient retainers, in the form of spring tabs 1224, that are integrally formed in the battery housing 1220. Each spring tab 1224 comprises a cantilevered spring arm 1226, an arcuate finger grip 1228, and a catch 1230. Further, the spring tabs 1224 function as a snap ring to mount the battery pack module 1200 to the PAPR module 1010. Specifically, the opposed catches 1230 are retained by the opposed lips 1206 (FIG. 20) on the lower body cover 1032, as will be discussed in greater detail hereinafter.

The battery housing 1220 further comprises two sets of external electrical terminals 1258 located on the interior wall 1252 thereof. Each electrical terminal 1258 is formed of suitable resilient conductive material and is generally an L-shaped member that comprises a resilient snap leg 1260 and a contact leg 1262. The snap legs 1260 pass through slots 1253 in the interior wall 1252 of the battery housing 1220. An angled snap finger 1266 is formed in the snap leg 1260. Therefore, once the electrical terminals 1258 are installed through the slots 1253, they cannot be unintentionally pulled back out. The snap legs 1260 are electrically connected to the batteries 1022. In the illustrated example, four electrical terminals 1258 are shown; however more or fewer are feasible.

The battery lid 1222 is a generally planar member and includes an over-molded gasket 1232 around the perimeter. The battery lid 1222 is press-fit over the open face of the battery housing 1220. The gasket 1232 seals the battery lid 1222 and battery housing 1220 together and holds the battery lid 1222 in place with respect to the battery housing 1220. The battery housing 1220 and battery lid 1222 together form an enclosed space 1090 (FIG. 19) in which the batteries 1022 can be located.

The battery pack module 1200 further comprises four commonly known battery terminals 1234 and battery clips 1236 to electrically connect the batteries 122 to the electrical system and to retain the batteries 1022 within the battery housing 1220. A receptacle, in the form of a charging port 1238, is also mounted to the battery housing 1220 and is electrically connected to the PAPR electrical system.

The batteries 1022 are one source of power for the PAPR module 1010 and provide power at least to the motor 1024 and the controller 1042. Suitable types of batteries 1022 include, but are not limited to, Lithium-Ion (Li-ion), Sulfur Dioxide Lithium (LiSO2), and Lithium CR123. The batteries 1022 can be rechargeable or disposable. The chart below shows exemplary flow rates and estimated run times with respect to the various battery types. Further, the two flow rates shown for a particular battery reflect the flow rate for utilizing either a single filter (chemical, biological, radiological, and nuclear (CBRN)) or two filters; the higher flow rate being associated with two filters.

| Battery Type | Flow Rate (lpm) | Est. Run Time (hrs) |
|---|---|---|
| STD Li-ion | 64 | 10+ |
| Rechargeable | 115 | ~6 |
| STD LiSO2 | 64 | ~8 |
| 10-Year | | |
| STD 123 (x4) | 64 | ~8 |
| Replaceable | | |
| EXT Li-ion | 64 | 15+ |
| Rechargeable | 115 | 8+ |
| EXT LiSO2 | 64 | 10+ |
| 10-Year | 115 | ~6 |

Figure 23:
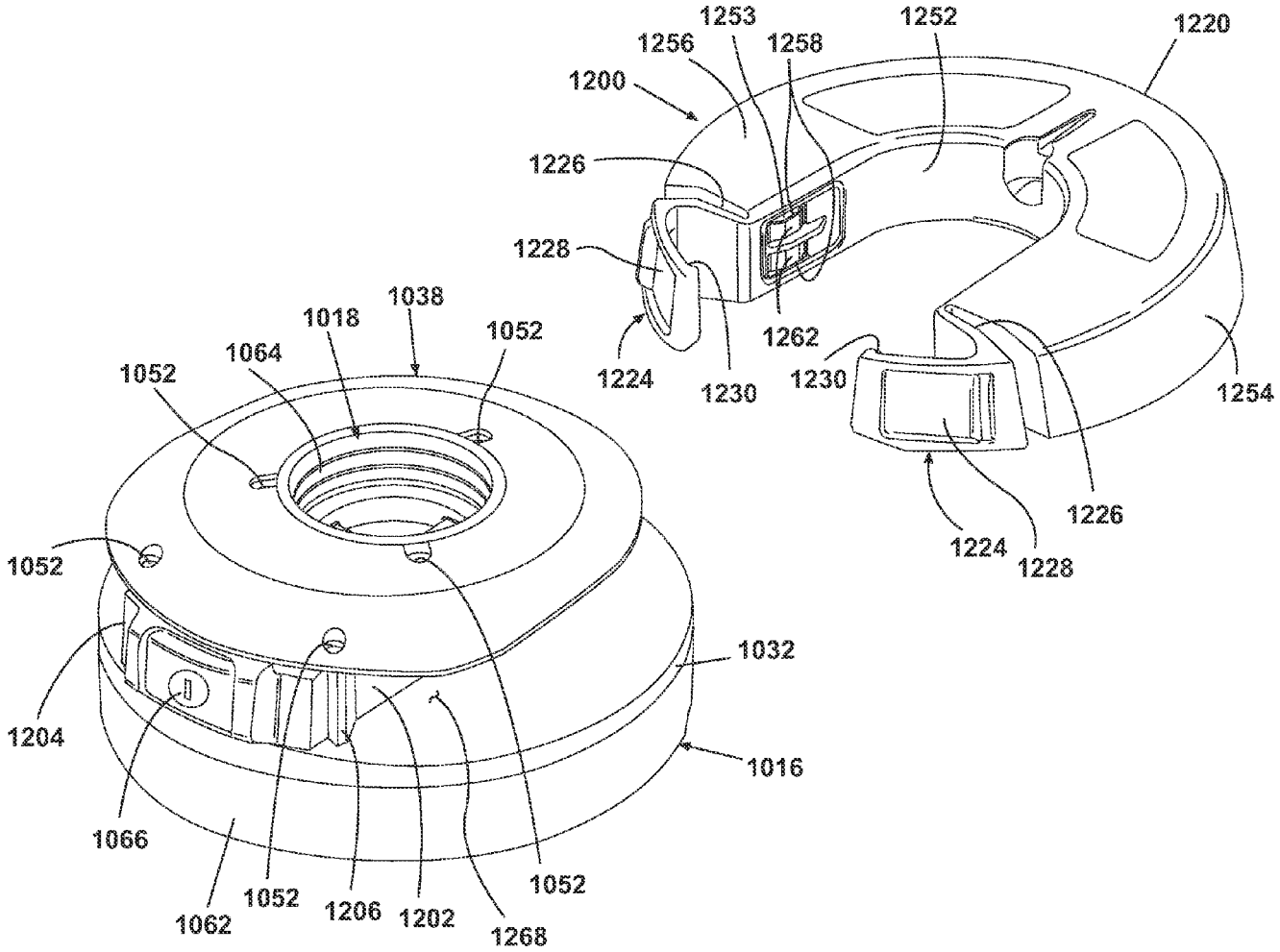
FIG. 23 is a partially exploded view of the PAPR module and battery pack module of FIG. 18, illustrating an uninstalled battery pack module.

Referring to FIGS. 18 and 23, in the installed position, the battery pack module 1200 is interposed between the lower body cover 1032 and the lid 1038 in the space defined as a battery pack opening 1268. The open end of the u-shaped battery pack 1220 fits around the threaded filter sleeve 1064 and ribs 1202 of the lower body cover 1032. That is to say, the interior wall 1252 of the battery housing 1220 is positioned adjacent to the threaded filter sleeve 1064 and ribs 1202 of the lower body cover 1032.

In this installed position, the catch 1230 of the battery housing's spring tab 1224 is retained by the lip 1206 of the lower body cover 1032. In this way, the spring tabs 1224 function similar to that of a conventional snap ring to mount the battery back 1200 to the PAPR module 1010. To remove the battery pack module 1200 from the PAPR module 1010, the user pushes/pulls the finger grips 1228 away from one another, flexing the spring arms 1226 of the spring tabs 1224 and thereby releasing the two catches 1230 from the lips 1206 of the lower body cover 1032. The battery pack module 1200 is then slid out of the battery pack opening 1268 and removed from the PAPR module 1010. The reverse process is used to install the battery pack module 1200 to the PAPR module 1010. For installation, the user inserts the battery pack module 1200 in the space battery pack opening 1268 and slides it into position. Just prior to fully seating the battery pack module 1200 to the PAPR module 1010, each catch 1230 on the battery housing 1220 rides along an angled wall that forms the lip 1206 on the lower housing cover 1032, flexing the spring arm 1226. Once the catch 1230 passes the lip 1206, the spring tab 1224 snaps back into unflexed position, thereby retaining the battery pack module 1200 to the PAPR module 1010.

Figure 24:
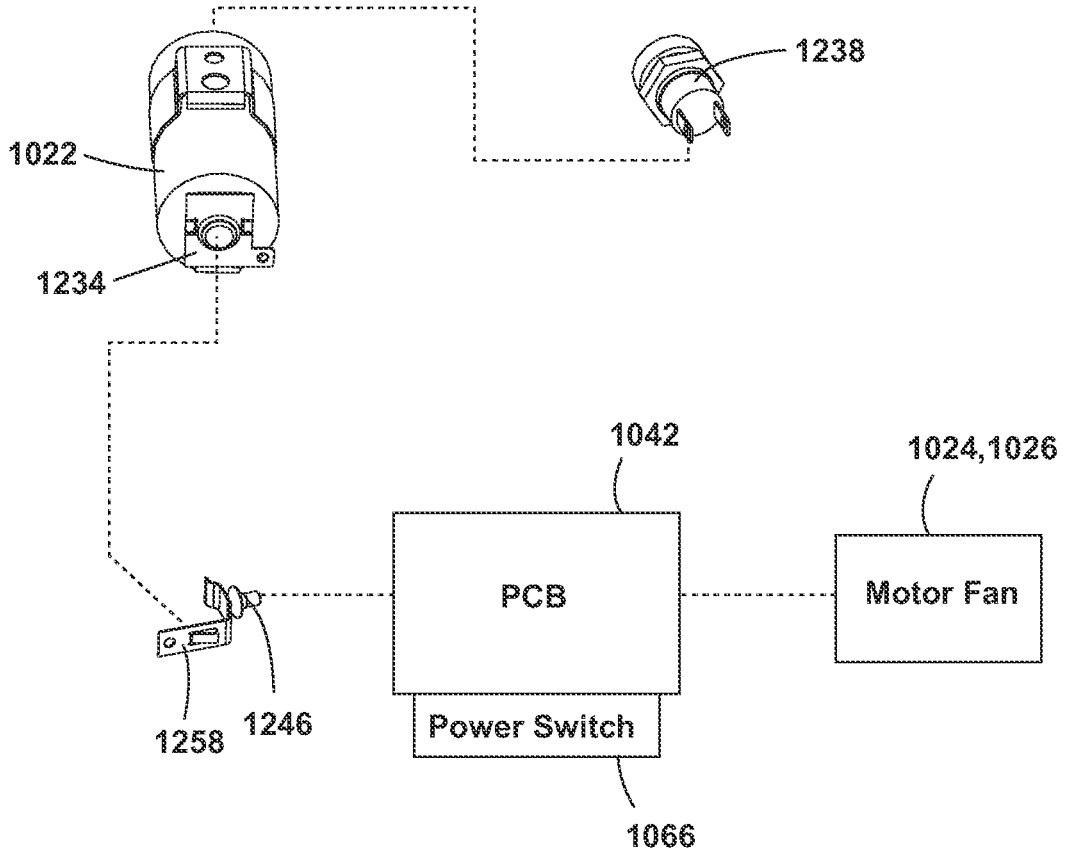
FIG. 24 is a schematic view of the electrical system of the PAPR module and battery pack module of FIG. 18.

The electrical system for the PAPR module 1010 is shown schematically in FIG. 24. The batteries 1022 are electrically connected to the controller 1042 via the battery terminals 1234, electrical terminals 1258, and rivet terminals 1246, which are in electrical communication. For example, electrical wiring (not shown) is connected between the battery terminal 1234 and electrical terminal 1258, and the rivet terminal 1246 and controller 1042. The electrical connection between the electrical terminal 1258 and rivet terminal 1246, however, is a direct physical contact. Specifically, the head 1248 of the rivet terminal 1246 contacts the contact leg 1262 of the electrical terminal 1258, thereby providing electrical contact between the battery housing 1200 and the lower body 1016 and the components contained therein. To operate the PAPR module 1010, the user depresses the power switch 1066 to supply power from the batteries 1022 to the controller 1042, which controls the current supplied to the motor 1024 and fan 1026.

The described electrical system is adapted to supply power to the PAPR module 1010 when the battery pack module 1200 is installed. Electrical contact is lost, however, when the battery pack module 1200 is removed, thereby breaking the physical contact between the electrical terminals 1258 and the rivet terminal 1246, located in the battery housing 1220 and the lower body cover 1032, respectively. Because it is quick and easy, this battery pack module 1200 installation method enables the user to "hot swap" one battery pack module 1200 for another. The user is able to quickly remove the spent battery pack module 1200 and install a fresh battery pack module 1200, thereby replacing the batteries within one breath cycle.

Figure 25:
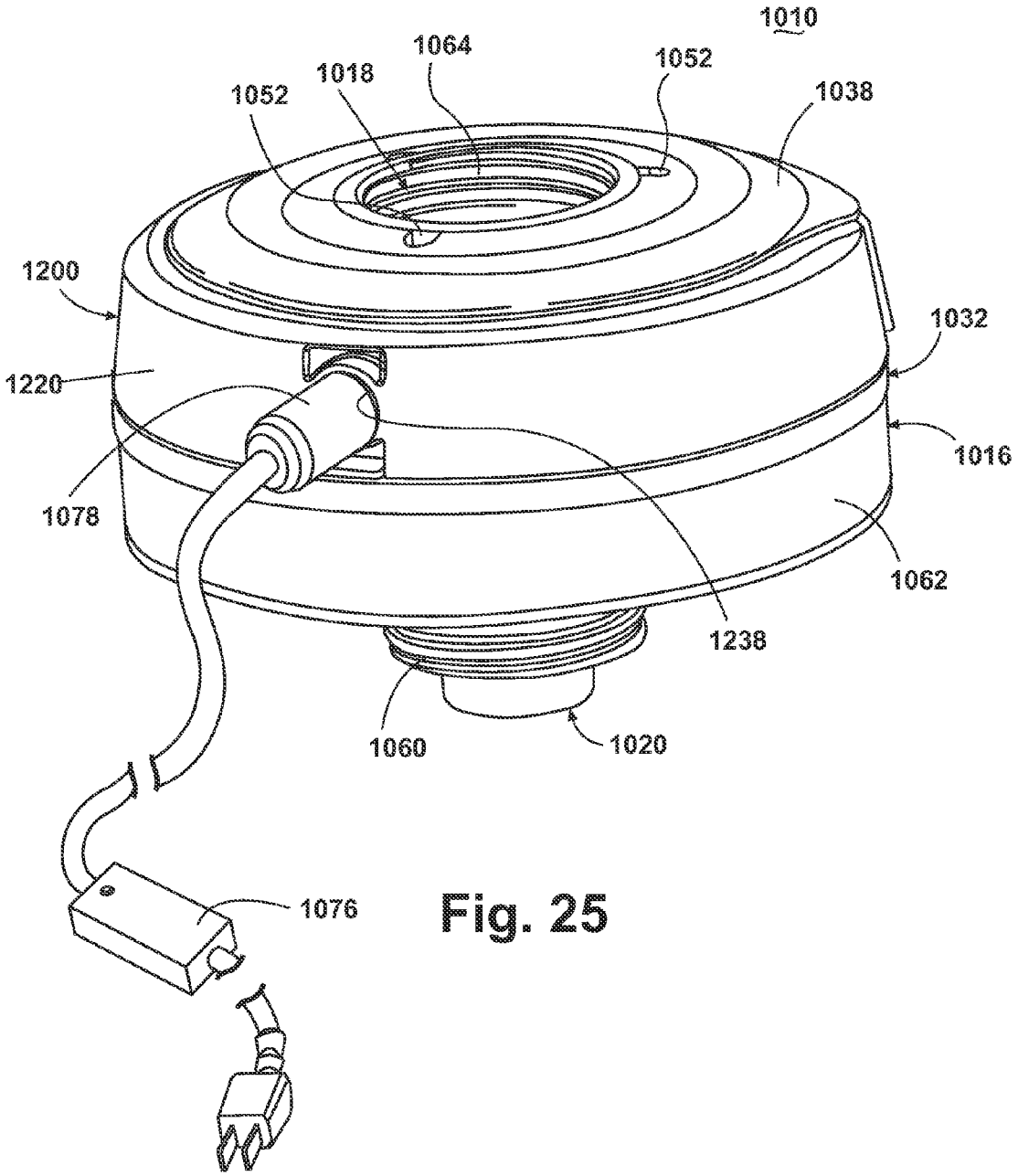
FIG. 25 is a rear view of the PAPR module and battery pack module of FIG. 18, showing an AC charger connected to a charging port.

Referring also to FIG. 25, power can also be supplied to the controller 1042 through the charging port 1238, which is electrically connected to the batteries 1022. Further, the enclosed rechargeable batteries 1022 may be charged through the charging port 1238. Charging the batteries 1022 is accomplished by affixing to the charging port 1238 a complementary plug 1078 of an AC charger 1076, which can be connected to an AC outlet to provide a power source for the PAPR module 1010. Optionally, an external battery pack can be connected to the PAPR module 1010 through the charging port 1238.

Figure 26:
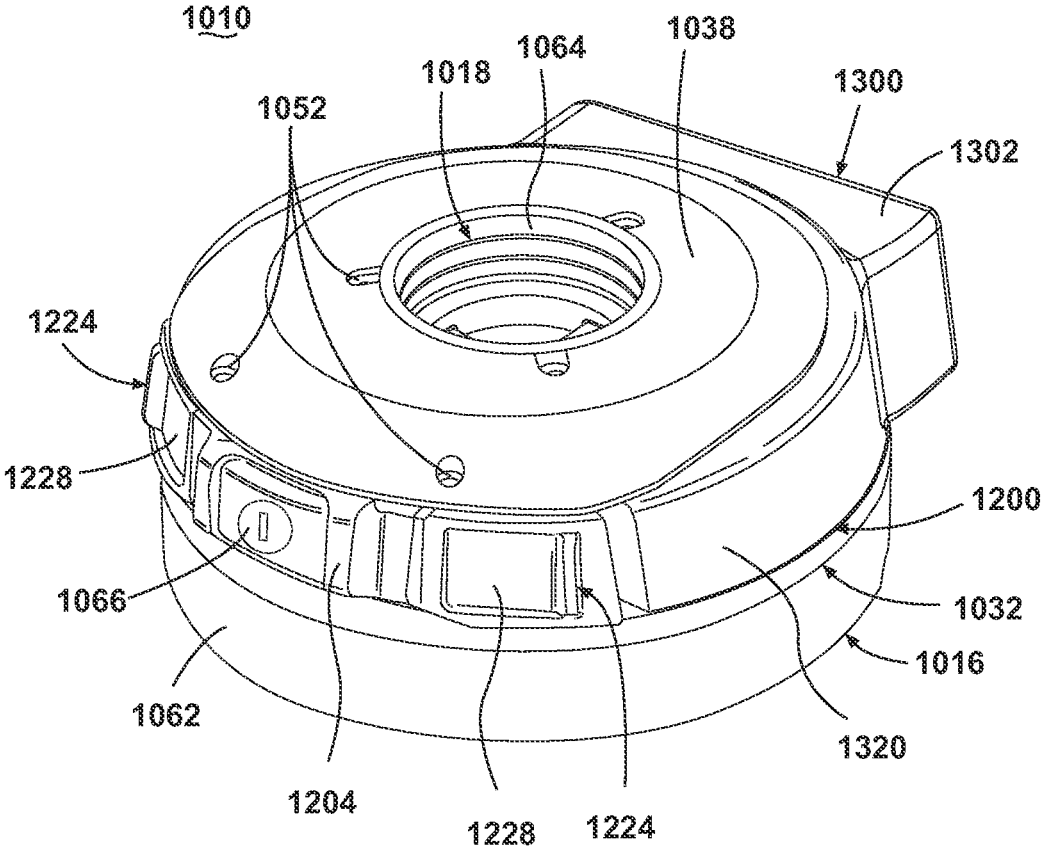
FIG. 26 is a perspective view of a PAPR module and extended life battery pack module according to a second sixth embodiment of the invention.
Figure 27:
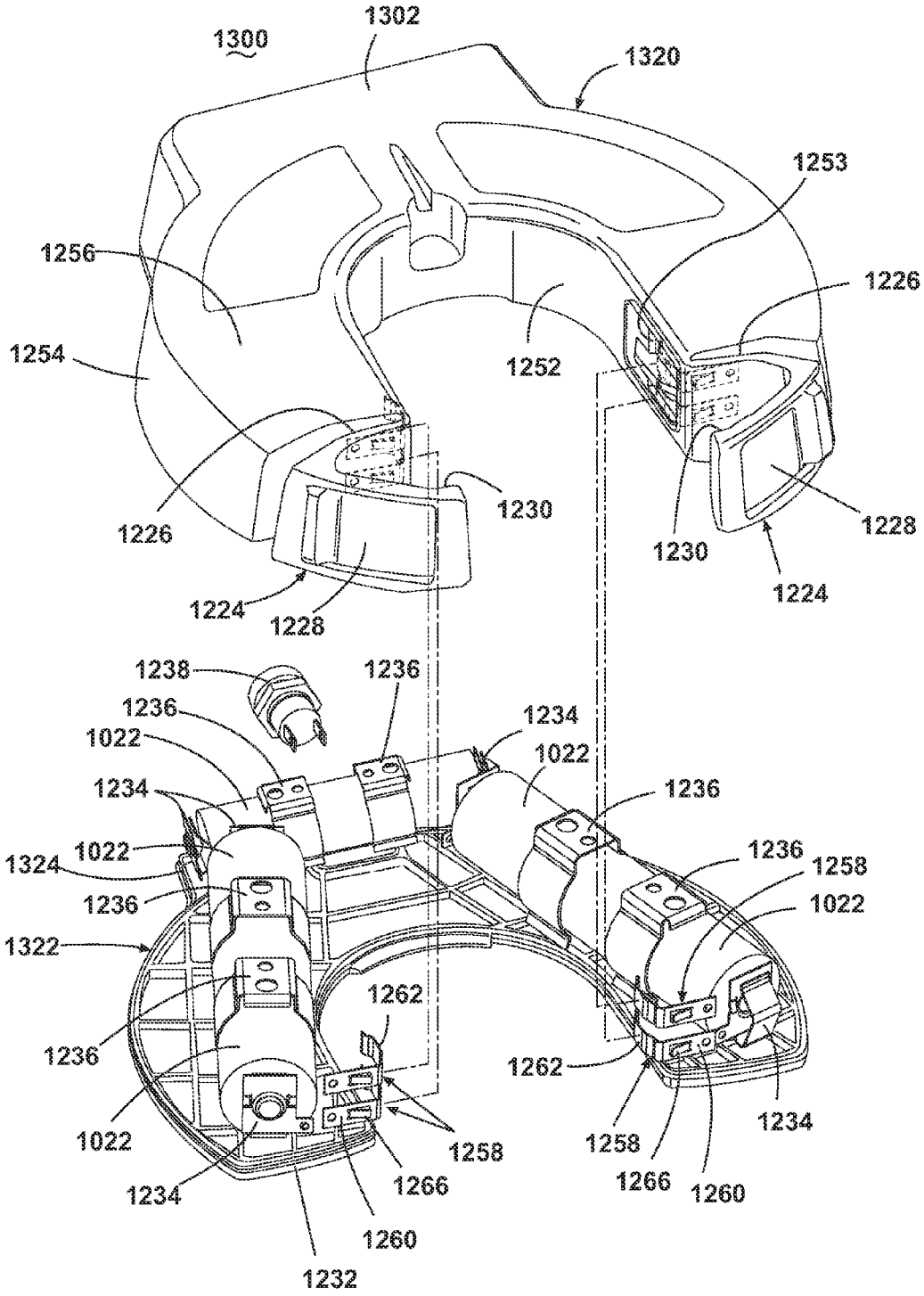
FIG. 27 is a partially exploded view of the extended life battery pack module of FIG. 26.

Referring now to FIGS. 26 and 27, a sixth embodiment of the invention is illustrated wherein components similar to those of the fifth embodiment described above are identified with like reference numerals. An extended life battery pack module 1300 is mounted to the PAPR module 1010 in lieu of the standard battery pack module 1200. The extended life battery pack module 1300 comprises a battery housing 1320 and a battery lid 1322 and is mounted to the PAPR module 1010 in an equivalent manner as that described above for the standard battery pack module 1200. The battery housing 1320 comprises an extension 1302 integrally formed therewith, in which at least one additional battery 1022 can be housed, providing extended use of the PAPR module 1010. The battery lid 1322 also comprises an extension 1324 to enclose the corresponding extension 1302 of the battery housing 1320. Further, any additional battery 1022 located within the extension 1302, 1324 is retained within the battery housing 1320 by an additional set of battery clips 1236 and is electrically connected to the electrical system by an additional set of battery terminals 1234. The remaining components illustrated, as well as the functionality of the PAPR module 1010, remain the same as that described above for the first embodiment.

Whereas the invention has been described with respect to a replaceable battery pack with two or three batteries, more than three batteries can be provided. For example, for the 123 replaceable battery module in the chart above, 6-8 replaceable batteries can be used. In the rechargeable battery modules, 3 or 4 rechargeable batteries can be used.

The invention provides for a quick and easily replaceable battery pack that supplies power to the powered air purifying respirator. This removable battery pack can be hot swapped in a contaminated environment. Further, the PAPR module can be operated with internal batteries housed in the battery pack, power supplied by an AC outlet, or an external battery pack. Additionally, an extended life battery pack containing at least one additional battery is also provided.

While the invention has been specifically described in connection with certain specific embodiments thereof, it is to be understood that this is by way of illustration and not of limitation. Reason variation and modification are possible within the scope of the forgoing disclosure and drawings without departing from the spirit of the invention which is defined in the appended claims.

What is claimed is:

1. A powered air purifying respirator (PAPR) module comprising:

a housing having a central axis and formed by an upper cylindrical portion and a lower cylindrical portion, wherein the upper cylindrical and lower cylindrical portions are axially aligned;

a fan mounted in the lower cylindrical portion and having a fan inlet and a fan outlet, a motor mounted in the housing and operably connected to the fan for driving the fan, and at least one battery mounted within the upper cylindrical portion and operably connected to the motor for powering the motor;

an inlet opening in the upper cylindrical portion in fluid communication with the fan inlet and configured to selectively mount a filter canister for filtering air that is drawn into the inlet opening;

an outlet opening formed in the lower cylindrical portion in fluid communication with the fan outlet, wherein the inlet and outlet openings are co-axially aligned; and a releasable mounting connector that is configured to mount the housing to a facepiece of a respirator mask and, alternatively, to a conduit that is fluidly connected to a facepiece inlet opening in a respirator mask;

whereby the powered air purifying respirator module can be positioned between a filter canister and a respirator mask and, alternatively, between a filter canister and a conduit that is connected to a respirator mask.

2. The powered air purifying respirator (PAPR) module according to claim 1 wherein the at least one battery is rechargeable.

3. The powered air purifying respirator (PAPR) module according to claim 1 wherein the at least one battery comprises multiple batteries that are spaced annularly about the central axis of the housing.

4. The powered air purifying respirator (PAPR) module according to claim 1 wherein the housing further has a receptacle electrically connected to the motor for powering the motor.

5. The powered air purifying respirator (PAPR) module according to claim 4 wherein the housing further has cable management grooves adjacent the receptacle for receiving a wire that is connected to the receptacle from either side of the receptacle.

6. The powered air purifying respirator (PAPR) module according to claim 1 wherein the at least one battery is rechargeable and the housing further has a receptacle electrically connected to the at least one battery for recharging the at least one battery.

7. The powered air purifying respirator (PAPR) module according to claim 1 and further comprising a controller electrically connected to the motor and the at least one battery for controlling the power to the motor.

8. The powered air purifying respirator (PAPR) module according to claim 7 wherein the controller is adapted to store data that can also be uploaded to a remote computer through an interface port to provide information related to conditions of the powered air purifying respirator module and/or operation thereof.

9. The powered air purifying respirator (PAPR) module according to claim 8 wherein the controller is adapted to receive inputs from a remote source for control of the powered air purifying respirator module.

10. The powered air purifying respirator (PAPR) module according to claim 9 wherein the interface port comprises a wireless transmitter.

11. The powered air purifying respirator (PAPR) module according to claim 9 wherein the interface port includes a receptacle in the housing that is electrically connected to the controller.

12. The powered air purifying respirator (PAPR) module according to claim 7 wherein the controller is adapted to monitor the speed of the fan and control the motor speed in response to the monitored fan speed to adjust the fan speed for a substantially constant flow rate through the powered air purifying respirator module.

13. The powered air purifying respirator (PAPR) module according to claim 7 wherein the controller is adapted to monitor the life of an external power source and to connect the motor to the at least one battery when the life of the external power source falls below a predetermined level.

14. The powered air purifying respirator (PAPR) module according to claim 1 and further comprising a scroll mounted between the fan outlet and the outlet opening to optimize the air flow to the outlet opening.

15. The powered air purifying respirator (PAPR) module according to claim 1 wherein the inlet opening is formed by an internally threaded sleeve.

16. The powered air purifying respirator (PAPR) module according to claim 1 wherein the outlet opening is formed by an externally threaded sleeve.

17. The powered air purifying respirator (PAPR) module according to claim 1 wherein the inlet opening is formed by a bayonet connector.

18. The powered air purifying respirator (PAPR) module according to claim 1 wherein the outlet opening is formed by a bayonet connector.

19. The powered air purifying respirator (PAPR) module according to claim 1 and further including an indicator for informing a user of a condition of the powered air purifying respirator module.

20. The powered air purifying respirator (PAPR) module claim 19 wherein the condition is the life of any of the at least one battery in the powered air purifying respirator module.

21. The powered air purifying respirator (PAPR) module claim 19 wherein the condition is low air flow through the powered air purifying respirator module.

22. The powered air purifying respirator (PAPR) module according to claim 19 wherein the indicator is an audible signal.

23. The powered air purifying respirator (PAPR) module according to claim 19 wherein the indicator is a visual signal.

24. The powered air purifying respirator (PAPR) module claim 23 wherein the visual signal extends around the circumference of the powered air purifying respirator module for viewing from any angle.

25. The powered air purifying respirator (PAPR) module according to claim 1 and further comprising a switch having an actuator mounted to an external portion of the housing for controlling the power to the motor, wherein the external portion of the housing on which the switch is mounted is rotatable with respect to other parts of the housing so that the switch can be oriented for operation by a right hand or left hand of a user.

26. The powered air purifying respirator (PAPR) module according to claim 1 and further comprising a remote switch spaced from the powered air purifying respirator module and connected to the at least one battery for powering on or off the powered air purifying respirator module.

27. The powered air purifying respirator (PAPR) module according to claim 1 and further comprising a remote heads up display adapted to be mounted to a mask or other structure that is visible to a user and connected to the powered air purifying respirator module to indicate a condition of the powered air purifying respirator module.

28. The powered air purifying respirator (PAPR) module according to claim 1 wherein the upper cylindrical portion comprises a battery pack module that includes the at least one battery and a lid, the lid having a battery pack opening that is configured to receive and selectively retain the battery pack module for quick release and replacement.

29. The powered air purifying respirator (PAPR) module according to claim 28 wherein the battery pack module has external terminals and the battery pack opening has exposed electrical terminals that are in electrical contact with the external terminals on the battery pack module when the battery pack module is installed in the battery pack opening.

30. The powered air purifying respirator (PAPR) module according to claim 29 wherein the battery pack module has a U-shaped housing.

31. The powered air purifying respirator (PAPR) module according to claim 30 wherein one of the battery pack module and the upper cylindrical portion has opposing resilient retainers that interface with opposed catches on the other of the upper cylindrical portion and the battery pack module to releasably retain the battery pack module in the battery pack opening.

32. The powered air purifying respirator (PAPR) module according to claim 31 wherein the opposing resilient retainers or the opposed catches are positioned on the ends of the legs of the U-shaped housing.

33. The powered air purifying respirator (PAPR) module according to claim 32 wherein the external terminals of the battery pack module are formed on the inside of the legs of the U-shaped housing.

34. The powered air purifying respirator (PAPR) module according to claim 28 wherein the battery pack module has at least 3 batteries.

35. An air purifying kit for use with a mask or hood and comprising:

one or more powered air purifying respirator (PAPR) modules according to claim 1;

one or more filtration modules that are adapted to mount to the one or more powered air purifying respirator modules and to filter chemical, biological, radiological and nuclear hazards, toxic industrial materials and particulate materials in the atmosphere;

optionally, an auxiliary power source with a wire that is adapted to connect to the one or more powered air purifying respirator modules and supply power to the motor therein;

optionally, a battery charger;

a belt for remotely mounting the one or more powered air purifying respirator modules to the body of a user;

a hose kit for connecting the one or more powered air purifying respirator modules to a mask or hood; and optionally, a heads up display for mounting to a mask or hood of a user.

* * * * *